US008771153B2

(12) United States Patent
Dalebout et al.

(10) Patent No.: US 8,771,153 B2
(45) Date of Patent: Jul. 8, 2014

(54) EXERCISE WEIGHT BAR WITH ROTATING HANDLE AND CAM SELECTION DEVICE

(75) Inventors: William Dalebout, North Logan, UT (US); Michael Olson, Logan, UT (US); Brandon Knudsen, Hyrum, UT (US); Nathan Plowman, Wellsville, UT (US)

(73) Assignee: Icon IP, Inc., Logan, UT (US)

( * ) Notice: Subject to any disclaimer, the term of this patent is extended or adjusted under 35 U.S.C. 154(b) by 666 days.

(21) Appl. No.: 13/022,788

(22) Filed: Feb. 8, 2011

(65) Prior Publication Data

US 2012/0115689 A1 May 10, 2012

Related U.S. Application Data

(60) Provisional application No. 61/411,465, filed on Nov. 8, 2010.

(51) Int. Cl.
*A63B 21/00* (2006.01)
*A63B 21/072* (2006.01)
*A63B 21/075* (2006.01)

(52) U.S. Cl.
CPC ..... *A63B 21/0726* (2013.01); *A63B 21/0728* (2013.01); *A63B 21/075* (2013.01)
USPC ..... 482/106; 482/107; 482/108

(58) Field of Classification Search
USPC ..... 482/104, 105, 106, 107, 108
See application file for complete search history.

(56) References Cited

U.S. PATENT DOCUMENTS 2,927,006 A 3/1960 Brooks
2,978,830 A 4/1961 Killian
5,123,885 A 6/1992 Shields
5,637,064 A 6/1997 Olson et al.
5,769,762 A 6/1998 Towley, III et al.
5,779,604 A 7/1998 Towley, III et al.
5,839,997 A 11/1998 Roth
5,876,313 A 3/1999 Krull
5,935,048 A 8/1999 Krull
5,944,642 A 8/1999 Krull
5,971,899 A 10/1999 Towley, III et al.
6,033,350 A 3/2000 Krull
6,099,442 A 8/2000 Krull
6,149,558 A 11/2000 Chen
6,174,268 B1 1/2001 Novak (Continued)

OTHER PUBLICATIONS

Related Design U.S. Appl. No. 29/385,021.

(Continued)

*Primary Examiner* — Jerome W Donnelly
(74) *Attorney, Agent, or Firm* — Holland & Hart LLP

(57) ABSTRACT

An exercise weight system includes an exercise weight bar, a plurality of weights selectively connectable to the exercise weight bar, and a cradle for holding the exercise weight bar and weights. The exercise weight bar has a rod having a longitudinal axis and a selector positioned on the rod such that the selector is rotatable about the longitudinal axis of the rod. The exercise weight bar includes an engagement system that permits a user to selectively secure one or more weights to the rod. The engagement system includes one or more weight engagement members and a binary cam system that selectively moves the one or more weights engagement members between a first position and a second position to selectively engage or disengage various combinations of the one or more weights when the selector is rotated about the longitudinal axis of the rod.

19 Claims, 28 Drawing Sheets

(56) References Cited

U.S. PATENT DOCUMENTS

| | | | |
|---|---|---|---|
| 6,183,397 | B1 | 2/2001 | Stearns et al. |
| 6,183,401 | B1 | 2/2001 | Krull |
| 6,186,927 | B1 | 2/2001 | Krull |
| 6,186,928 | B1 | 2/2001 | Chen |
| 6,196,952 | B1 | 3/2001 | Chen |
| 6,228,003 | B1 | 5/2001 | Hald et al. |
| 6,261,022 | B1 | 7/2001 | Dalebout et al. |
| 6,322,481 | B1 | 11/2001 | Krull |
| 6,350,221 | B1 | 2/2002 | Krull |
| 6,387,018 | B1 | 5/2002 | Krull |
| 6,387,019 | B1 | 5/2002 | Krull |
| 6,402,666 | B2 | 6/2002 | Krull |
| 6,416,446 | B1 | 7/2002 | Krull |
| 6,422,979 | B1 | 7/2002 | Krull |
| 6,436,013 | B1 | 8/2002 | Krull |
| 6,447,432 | B1 | 9/2002 | Krull |
| 6,491,610 | B1 | 12/2002 | Henn |
| 6,500,101 | B1 | 12/2002 | Chen |
| 6,540,650 | B1 | 4/2003 | Krull |
| 6,623,407 | B2 | 9/2003 | Novak et al. |
| 6,629,910 | B1 | 10/2003 | Krull |
| 6,656,093 | B2 | 12/2003 | Chen |
| 6,666,800 | B2 | 12/2003 | Krull |
| 6,669,606 | B2 | 12/2003 | Krull |
| 6,679,816 | B1 | 1/2004 | Krull |
| 6,719,674 | B2 | 4/2004 | Krull |
| 6,733,424 | B2 | 5/2004 | Krull |
| 6,746,381 | B2 | 6/2004 | Krull |
| 6,749,547 | B2 | 6/2004 | Krull |
| D500,820 | S | 1/2005 | Krull |
| 6,855,097 | B2 | 2/2005 | Krull |
| 6,872,173 | B2 | 3/2005 | Krull |
| 6,896,645 | B1 | 5/2005 | Krull |
| 6,899,661 | B1 | 5/2005 | Krull |
| 6,902,516 | B2 | 6/2005 | Krull |
| 6,974,405 | B2 | 12/2005 | Krull |
| 6,997,856 | B1 | 2/2006 | Krull |
| 7,029,425 | B2 | 4/2006 | Krull |
| 7,048,677 | B2 | 5/2006 | Mackert et al. |
| 7,060,011 | B1 | 6/2006 | Krull |
| 7,066,867 | B2 | 6/2006 | Krull |
| 7,077,790 | B1 | 7/2006 | Krull |
| 7,077,791 | B2 | 7/2006 | Krull |
| 7,112,163 | B2 | 9/2006 | Krull |
| 7,128,696 | B1 | 10/2006 | Krull |
| 7,128,697 | B1 | 10/2006 | Krull |
| 7,141,008 | B2 | 11/2006 | Krull et al. |
| 7,153,243 | B1 | 12/2006 | Krull |
| 7,156,782 | B1 | 1/2007 | Krull |
| 7,156,783 | B2 | 1/2007 | Chen |
| 7,223,214 | B2 | 5/2007 | Chen |
| 7,261,678 | B2 | 8/2007 | Crawford |
| 7,264,578 | B1 | 9/2007 | Krull |
| 7,291,098 | B1 | 11/2007 | Krull |
| 7,291,102 | B2 | 11/2007 | Mackert et al. |
| 7,300,390 | B1 | 11/2007 | Krull |
| 7,361,123 | B1 | 4/2008 | Krull |
| 7,367,927 | B2 | 5/2008 | Krull |
| 7,387,597 | B2 | 6/2008 | Krull |
| 7,387,867 | B2 | 6/2008 | Hasegawa et al. |
| 7,497,813 | B1 | 3/2009 | Krull |
| 7,497,814 | B1 | 3/2009 | Krull |
| 7,507,186 | B2 | 3/2009 | Stearns et al. |
| 7,507,189 | B2 | 3/2009 | Krull |
| 7,534,199 | B2 | 5/2009 | Krull |
| 7,537,550 | B1 | 5/2009 | Krull |
| 7,540,832 | B2 | 6/2009 | Krull |
| 7,547,268 | B1 | 6/2009 | Krull |
| 7,563,208 | B1 | 7/2009 | Chen |
| 7,614,982 | B2 | 11/2009 | Crawford |
| 7,614,983 | B1 | 11/2009 | Krull |
| 7,614,984 | B1 | 11/2009 | Krull |
| 7,621,855 | B1 | 11/2009 | Krull |
| 7,625,322 | B1 | 12/2009 | Krull |
| 7,648,448 | B2 | 1/2010 | Krull |
| 7,766,800 | B1 | 8/2010 | Krull |
| D628,251 | S | 11/2010 | Krull et al. |
| 7,914,424 | B1 | 3/2011 | Krull |
| 7,976,443 | B2 | 7/2011 | Krull |
| 7,981,012 | B1 | 7/2011 | Krull |
| 7,981,013 | B2 | 7/2011 | Krull |
| 8,002,678 | B1 | 8/2011 | Krull |
| 8,033,965 | B1 | 10/2011 | Krull |
| 8,137,248 | B1 | 3/2012 | Krull |
| 2002/0055426 | A1 | 5/2002 | Krull |
| 2004/0005968 | A1* | 1/2004 | Crawford et al. ..... 482/106 |
| 2006/0021155 | A1 | 2/2006 | Lang et al. |
| 2009/0186748 | A1 | 7/2009 | Golesh |
| 2010/0003573 | A1 | 1/2010 | Jeanne et al. |
| 2012/0149537 | A1 | 6/2012 | Krull |
| 2012/0149538 | A1 | 6/2012 | Krull |

OTHER PUBLICATIONS

Related Design U.S. Appl. No. 29/385,025.

* cited by examiner

EXERCISE WEIGHT BAR WITH ROTATING HANDLE AND CAM SELECTION DEVICE

CROSS-REFERENCE TO RELATED APPLICATIONS

This application is a non-provisional of, and claims the benefit of and priority to, U.S. Patent Application Ser. No. 61/411,465, filed on Nov. 8, 2010, and entitled "WEIGHT-LIFTING EXERCISE DEVICE WITH MECHANISM FOR SELECTIVELY ENGAGING AND DISENGAGING WEIGHTS," which application is expressly incorporated herein by this reference in its entirety.

TECHNICAL FIELD

This invention relates generally to exercise devices, assemblies, and systems, and more particularly to exercise weight systems with removable weight plates.

BACKGROUND

Various strength training devices and systems have been developed to improve health and fitness, such as those described in U.S. Patent Publication No. 2004/0005968 to Crawford et al. ("Crawford"). Crawford discloses a dumbbell that includes a handle having a grip and at least one end. An inner plate is mounted on the handle adjacent the grip in a fixed rotational orientation. A support plate is rotationally mounted on the handle adjacent the inner plate. At least one collar is rotationally mounted on the handle adjacent the support plate and rotationally fixed with the support plate. A selector knob is rotationally mounted on the handle adjacent the at least one collar, and rotationally fixed to the collar. A weight plate is removably mounted on the handle adjacent the at least one collar by rotating the selector knob, which in turn rotates the at least one collar into engagement with the weight plate. In addition, various other devices and/or dumbbells have been devised in an effort to make strength training convenient and accessible.

In addition, other exercise devices include those in U.S. Patent Publication No. 2009/0186748, U.S. Patent Publication No. 2006/0211550, U.S. Patent Publication No. 2008/0039299, U.S. Patent Publication No. 2010/0035736, U.S. Pat. Nos. 5,123,885, 5,637,064, 5,769,762, 5,779,604, 5,839,997, 5,971,899, 6,149,558, 6,186,928, 6,196,952, 6,228,003, 6,261,022, 6,402,666, 6,416,446, 6,500,101, 6,540,650, 6,669,606, 6,679,816, 6,719,674, 6,749,547, D500,820, 6,855,097, 6,872,173, 6,899,661, 6,997,856, 7,066,867, 7,077,791, 7,261,678, and 7,534,199.

SUMMARY OF THE INVENTION

In one aspect of the disclosure, an exercise weight system includes a rod having a longitudinal axis, a selector, one or more weights selectively securable to the rod, and an engagement system that selectively secures the one or more weights to the rod.

In another aspect that may be combined with any of the aspects herein, the selector is positioned on the rod such that the selector is rotatable about the longitudinal axis of the rod and relative to the one or more weights.

In another aspect that may be combined with any of the aspects herein, the selector is graspable during the performance of an exercise.

In another aspect that may be combined with any of the aspects herein, rotation of the selector relative to the weights causes the engagement system to selectively engage or disengage the one or more weights.

In another aspect that may be combined with any of the aspects herein, the engagement system comprises one or more weight engagement members linked to the selector such that rotation of the selector about the longitudinal axis of the rod moves the one or more weight engagement members between a first position and a second position to selectively engage or disengage the one or more weights.

In another aspect that may be combined with any of the aspects herein, the engagement system comprises one or more collars positioned about the rod such that the one or more collars are rotatable about the longitudinal axis of the rod.

In another aspect that may be combined with any of the aspects herein, each of the one or more weights comprises one or more engagement surfaces and each of the one or more weight engagement members comprises one or more engagement surfaces.

In another aspect that may be combined with any of the aspects herein, the engagement surfaces of the one or more weights and the engagement surfaces of the weight engagement members engage one another only when the weight engagement members are in the first position.

In another aspect that may be combined with any of the aspects herein, the one or more weight engagement members are linked to the selector by a binary cam system.

In another aspect that may be combined with any of the aspects herein, the binary cam system comprises one or more collars mounted on the rod such that the one or more collars are rotatable about the longitudinal axis of the rod.

In another aspect that may be combined with any of the aspects herein, each of the one or more collars comprises a cam surface.

In another aspect that may be combined with any of the aspects herein, the binary cam system comprises a cam follower on each of the weight engagement members.

In another aspect that may be combined with any of the aspects herein, the cam followers engage the cam surfaces on the one or more collars.

In another aspect that may be combined with any of the aspects herein, each of the cam surfaces comprises at least one high portion and at least one low portion.

In another aspect that may be combined with any of the aspects herein, the at least one high portion and the at least one low portion rotate about the axis of the rod as the selector rotates about the axis of the rod.

In another aspect that may be combined with any of the aspects herein, the cam followers alternatingly engage the high and low portions of the cam surfaces as the selector is rotated about the longitudinal axis of the rod, thereby moving the one or more weight engagement members between the first position and the second position.

In another aspect that may be combined with any of the aspects herein, the at least one high portion is aligned with a first position along the length of the rod and the at least one low portion is aligned with a second position along the length of the rod.

In another aspect that may be combined with any of the aspects herein, the at least one high portion is disposed radially further away from the rod than the at least one low portion.

In another aspect that may be combined with any of the aspects herein, the one or more weight engagement members pivot between the first and second positions.

In another aspect that may be combined with any of the aspects herein, the one or more weight engagement members pivot between the first and second positions in a direction that is at least partially along the length of the rod.

In another aspect that may be combined with any of the aspects herein, the one or more weight engagement members are pivoted further away from the rod when the one or more weight engagement members are in the first position.

In another aspect that may be combined with any of the aspects herein, the one or more weight engagement members are pivoted closer to the rod when the one or more weight engagement members are in the second position In another aspect that may be combined with any of the aspects herein, a biasing member biases the one or more weight engagement members toward the first position.

In another aspect that may be combined with any of the aspects herein, the engagement system comprises one or more collars and one or more weight engagement members.

In another aspect that may be combined with any of the aspects herein, the one or more collars are positioned about the rod.

In another aspect that may be combined with any of the aspects herein, each of the one or more collars has a cam surface formed thereon.

In another aspect that may be combined with any of the aspects herein, the one or more collars are linked to the selector such that rotation of the selector about the longitudinal axis causes the cam surfaces of the one or more collars to rotate about the longitudinal axis.

In another aspect that may be combined with any of the aspects herein, the one or more weight engagement members are movable between first and second positions relative to the rod.

In another aspect that may be combined with any of the aspects herein, each of the one or more weight engagement members has a cam follower that engages a cam surface on the one or more collars.

In another aspect that may be combined with any of the aspects herein, the engagement between the cam followers and the cam surfaces causes the one or more weight engagement members to move between the first and second positions as the selector is rotated about the longitudinal axis of the rod.

In another aspect that may be combined with any of the aspects herein, the one or more weight engagement members disengage the one or more weights when the one or more weight engagement members are in the first position.

In another aspect that may be combined with any of the aspects herein, the one or more weight engagement members engage and secure the one or more weights to the rod when the one or more weight engagement members are in the second position.

In another aspect that may be combined with any of the aspects herein, the cam surfaces of each of the one or more collars comprises at least one high portion and at least one low portion.

In another aspect that may be combined with any of the aspects herein, the one or more weight engagement members are moved to the first position when the cam followers engage the low portions.

In another aspect that may be combined with any of the aspects herein, the one or more weight engagement members are moved to the second position when the cam followers engage the high portions.

In another aspect that may be combined with any of the aspects herein, the at least one high portion of each of the one or more collars is disposed radially further away from the rod than the at least one low portion of each of the one or more collars.

In another aspect that may be combined with any of the aspects herein, the rod has first and second ends and the longitudinal axis extends therebetween.

In another aspect that may be combined with any of the aspects herein, the selector is mounted on the rod between the first and second ends of the rod.

In another aspect that may be combined with any of the aspects herein, the exercise weight system further includes first and second weight mounts positioned on the respective first and second ends of the rod.

In another aspect that may be combined with any of the aspects herein, the first and second weight mounts each selectively receive a plurality of weights to facilitate selective securement of the pluralities of weights to the rod.

In another aspect that may be combined with any of the aspects herein, the first and second weight mounts each comprise an engagement system that selectively secures the plurality of weights to the rod.

In another aspect that may be combined with any of the aspects herein, the engagement system comprises a plurality of weight engagement members and a binary cam system.

In another aspect that may be combined with any of the aspects herein, the plurality of weight engagement members pivot between first and second positions relative to the rod.

In another aspect that may be combined with any of the aspects herein, the plurality of weight engagement members disengage the plurality of weights when the plurality of weight engagement members are pivoted to the first position.

In another aspect that may be combined with any of the aspects herein, the plurality of weight engagement members engage and secure the plurality of weights to the rod when the plurality of weight engagement members are pivoted to the second position.

In another aspect that may be combined with any of the aspects herein, the binary cam system selectively pivots the plurality of weight engagement members between the first and second positions when the selector is rotated about the longitudinal axis of the rod.

In another aspect that may be combined with any of the aspects herein, the plurality of weight engagement members pivot between the first and second positions in a direction that is at least partially along the length of the rod.

In another aspect that may be combined with any of the aspects herein, the plurality of weight engagement members pivot between the first and second positions in a plane that is generally perpendicular to the longitudinal axis of the rod.

In another aspect that may be combined with any of the aspects herein, an exercise weight system includes a rod with a longitudinal axis, one or more weights selectively securable to the rod; a selector positioned on the rod, and an engagement system that selectively secures the weights to the rod.

In another aspect that may be combined with any of the aspects herein, the selector is rotatable about the longitudinal axis of the rod.

In another aspect that may be combined with any of the aspects herein, the engagement system includes one or more weight engagement members and one or more cam followers.

In another aspect that may be combined with any of the aspects herein, the one or more weight engagement members are positioned about the rod.

In another aspect that may be combined with any of the aspects herein, each of the one or more weight engagement members has at least one cam surface formed thereon.

In another aspect that may be combined with any of the aspects herein, the one or more weight engagement members are movable along at least a portion of the rod between first and second positions.

In another aspect that may be combined with any of the aspects herein, the one or more cam followers are linked to the selector such that rotation of the selector about the longitudinal axis of the rod causes the one or more cam followers to rotate about the longitudinal axis of the rod.

In another aspect that may be combined with any of the aspects herein, each of the one or more cam followers engages at least one of the cam surfaces of the one or more weight engagement members.

In another aspect that may be combined with any of the aspects herein, the engagement between the cam followers and the cam surfaces causes the one or more weight engagement members to move between the first and second positions as the selector and cam followers are rotated about the longitudinal axis of the rod.

In another aspect that may be combined with any of the aspects herein, the one or more weight engagement members disengage the one or more weights when the one or more weight engagement members are in the first position, and the one or more weight engagement members engage and secure the one or more weights to the rod when the one or more weight engagement members are in the second position.

In another aspect that may be combined with any of the aspects herein, the cam surfaces of each of the one or more weight engagement members comprise at least one high portion and at least one low portion.

In another aspect that may be combined with any of the aspects herein, the one or more weight engagement members are moved to the first position when the cam followers engage the low positions, and the one or more weight engagement members are moved to the second position when the cam followers engage the high positions.

In another aspect that may be combined with any of the aspects herein, the engagement system includes one or more collars and one or more weight engagement members.

In another aspect that may be combined with any of the aspects herein, the one or more collars are positioned about the rod and are rotatable about the longitudinal axis of the rod.

In another aspect that may be combined with any of the aspects herein, the one or more collars are linked to the selector such that rotation of the selector about the longitudinal axis of the rod causes the one or more collars to rotate about the longitudinal axis of the rod.

In another aspect that may be combined with any of the aspects herein, each of the one or more collars has at least one cam surface formed thereon.

In another aspect that may be combined with any of the aspects herein, the one or more weight engagement members pivot between first and second positions relative to the rod.

In another aspect that may be combined with any of the aspects herein, each of the one or more weight engagement members comprise a cam follower that engages at least one of the cam surfaces of the one or more collars.

In another aspect that may be combined with any of the aspects herein, the engagement between the cam followers and the cam surfaces causes the one or more weight engagement members to pivot between the first and second positions as the selector and collars are rotated about the longitudinal axis of the rod.

In another aspect that may be combined with any of the aspects herein, the one or more weight engagement members disengage the one or more weights when the one or more weight engagement members are in the first position, and the one or more weight engagement members engage and secure the one or more weights to the rod when the one or more weight engagement members are in the second position.

In another aspect that may be combined with any of the aspects herein, the weight engagement members pivot between the first and second positions in one or more planes that are generally perpendicular to the longitudinal axis of the rod.

DETAILED DESCRIPTION

Figure 1:
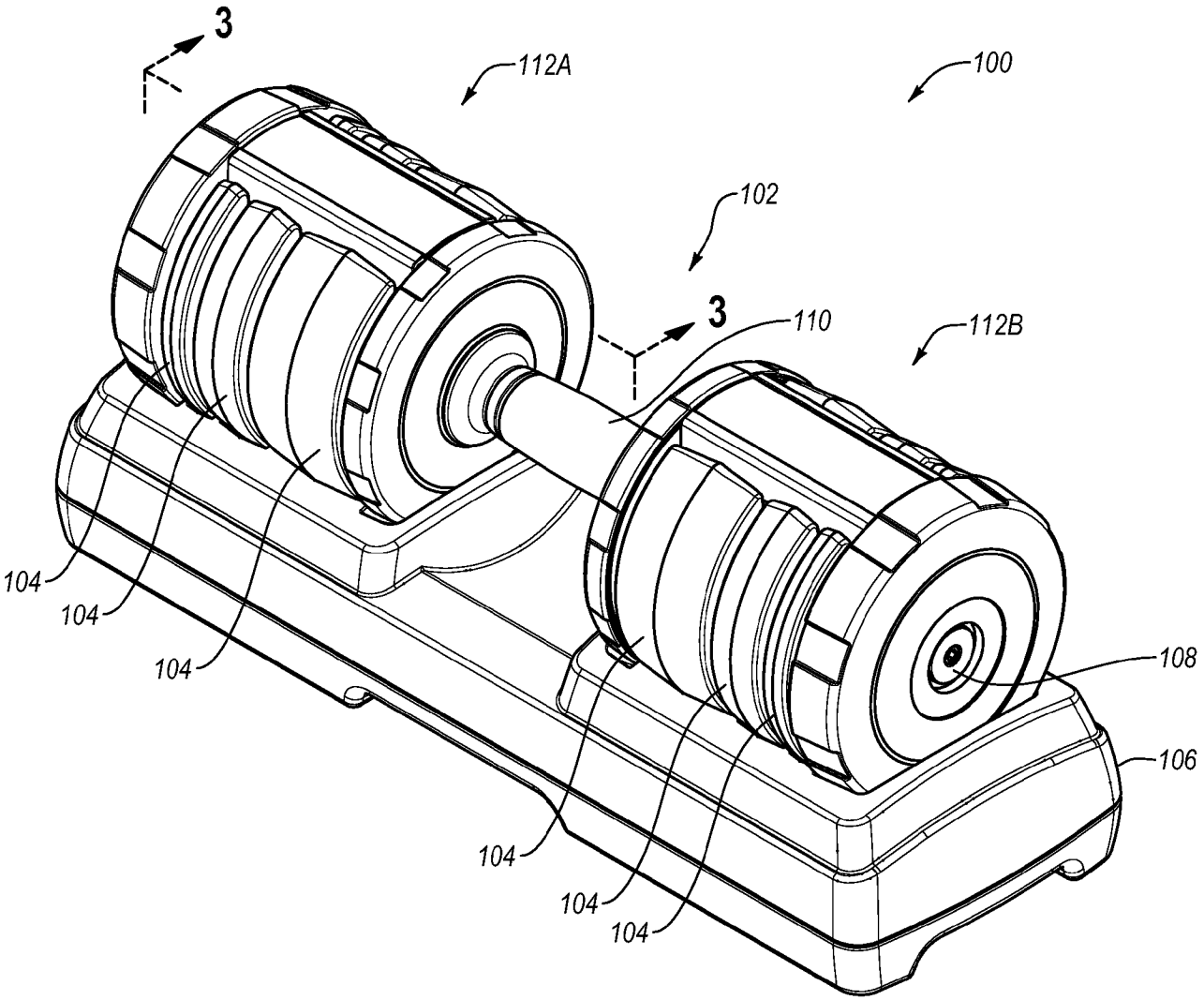
FIG. 1 is a perspective view of an exercise weight system according to one embodiment of the present invention.

Referring to FIG. 1, an exercise weight system 100 includes an exercise weight bar 102, a plurality of weights 104, and a cradle 106 designed to hold exercise weight bar 102 and/or plurality of weights 104. Weights 104 can be selectively and individually or collectively connected to exercise weight system 100 such that the weight of exercise weight bar 102 can be adjusted as desired. Weights 104 that are not connected to exercise weight bar 102 may remain positioned in cradle 106 while exercise weight bar 102 and the connected weights 104 are removed from cradle 106 during exercise.

Exercise weight bar 102 includes a rod 108 that extends generally between opposing ends of exercise weight bar 102. A selector 110 and weight mounts 112A, 112B are disposed on rod 108. In the illustrated embodiment, weight mount 112A is mounted on a first end of rod 108, weight mount 112B is mounted on a second end of rod 108, and selector 110 is mounted on rod 108 between weight mounts 112A, 112B. As shown in FIG. 1, weight mounts 112A, 112B are each designed to selectively engage up to three weights 104. It is understood that weight mounts 112A, 112B may be designed to receive greater or fewer weights 104.

As shown and described, exercise weight bar 102 is designed as a dumbbell with selector 110 being generally sized in length and circumference to be held by a user with one or two hands during exercise. As discussed herein, selector 110 can be used to select and connect weights 104 to exercise weight bar 102. Additionally, selector 110 can be gripped by a user during exercise. Accordingly, selector 110 may also be referred to a grip 110. Selector 110 can include a textured or non-slip surface or material to provide an improved grip during exercise. While the illustrated embodiments depict selector 110 performing both the weight selection and grip functions, it is understood that some embodiments of the present invention may include selectors and grips that are separate from one another. Thus, in some embodiments, a selector may be used to select weights while a separate grip may be used to hold the exercise device during use.

Figure 2:
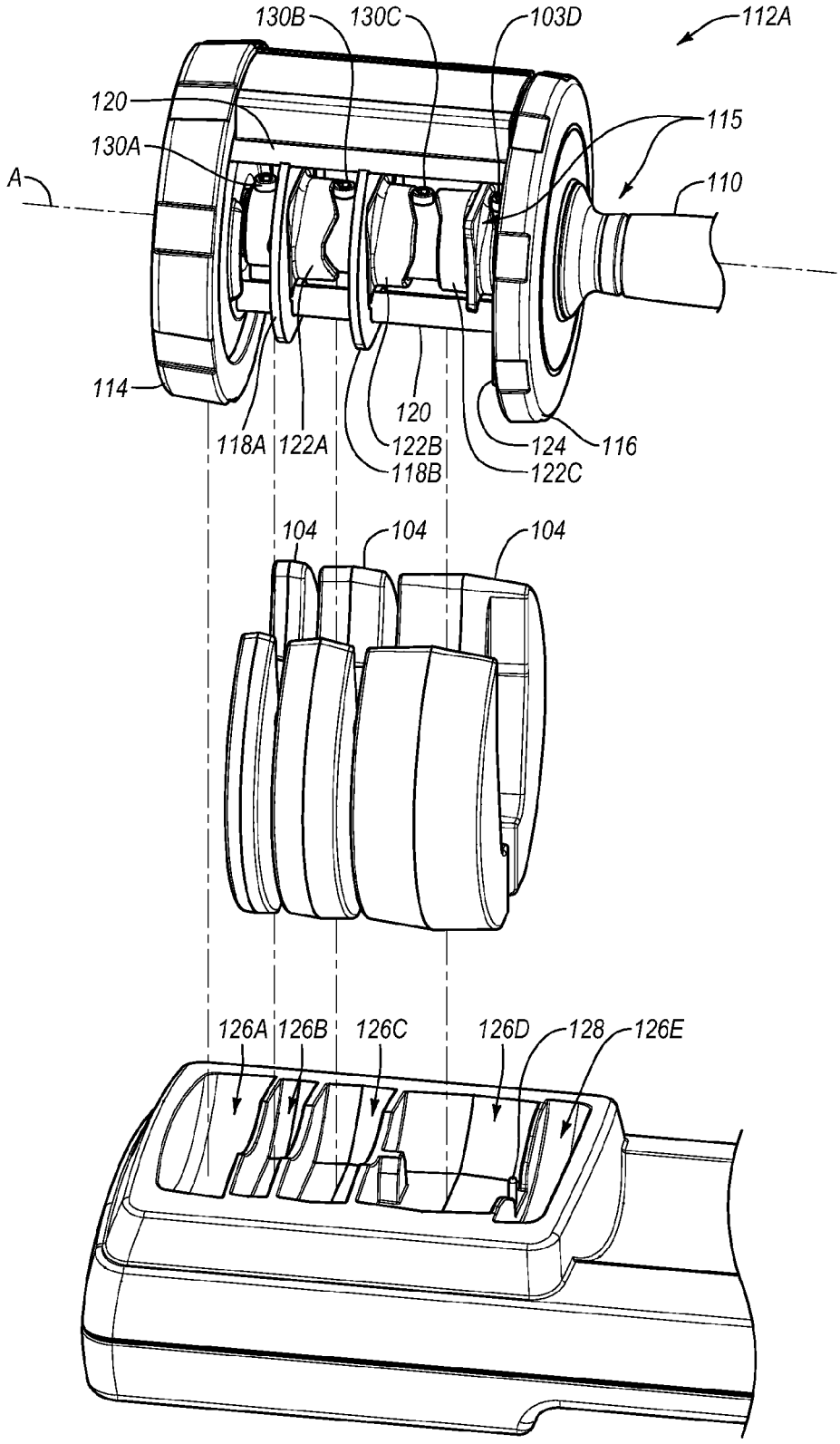
FIG. 2 is a partially exploded view of the exercise weight system of FIG. 1.

FIG. 2 illustrates a partially exploded view of the first end of exercise weight system 100. As shown in FIG. 2, weight mount 112A includes first and second end caps 114, 116 and first and second weight dividers 118A, 118B that cooperate to define slots for receiving weights 104. First and second end caps 114, 116 and first and second weight dividers 118A, 118B are connected to one another, such as with braces 120, and to rod 108 to substantially prevent movement of weights 104 along the axis of rod 108.

Exercise weight bar 102 also includes an engagement system 115 designed to selectively and securely connect weights 104 to exercise weight bar 102. Engagement system 115 includes selector 110, collars 122A, 122B, 122C disposed around rod 108, and pins 130A, 130B, 130C, 130D. Braces 120 are designed to substantially prevent collars 122A, 122B, 122C from rotating relative to or about rod 108. Collars 122A, 122B, 122C are individual tubular members slidably mounted about rod 108 such that collars 122A, 122B, 122C can slide at least partially along the length of rod 108 between a disengaged position and an engaged position and in a direction that is generally parallel to or at least partially along longitudinal axis A of rod 108. When collars 122A, 122B, 122C are in the disengaged position, weights 104 can be received by weight mount 112A. Once one or more weights 104 are received by weight mount 112A, collars 122A, 122B, 122C can be moved to the engaged position to selectively and securely connect one or more of weights 104 to exercise weight bar 102. As will also be discussed below, weight mount 112A also includes a locking mechanism 124 that prevents collars 122A, 122B, 122C from moving between the disengaged and engaged positions when exercise weight bar 102 is removed from cradle 106.

Figure 3:
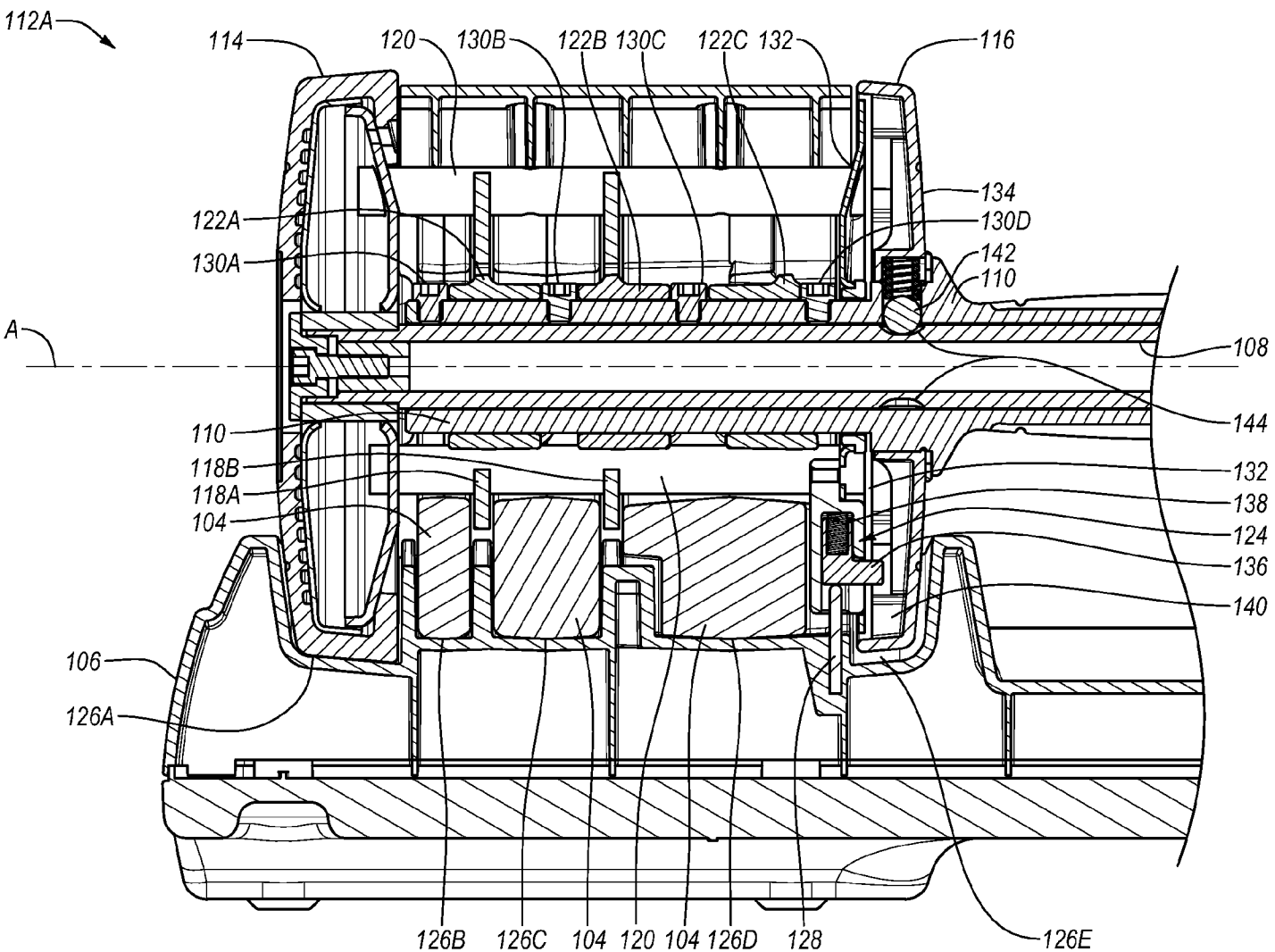
FIG. 3 is a partial cross-sectional view of the exercise weight system of FIG. 1.

As can also be seen in FIG. 2, cradle 106 includes channels 126A-E that are designed to receive and support first and second end caps 114, 116 and weights 104 therein. As shown in FIG. 3, channels 126A, slidably are sized and shaped to receive at least a portion of respective first and second end caps 114, 116 therein. Similarly, each of channels 126B, 126C, 126D is sized and shaped to receive at least a portion of a weight plate 104 therein as shown in FIG. 3. Extending from or adjacent to channel slidably is a locking pin 128 which cooperates with locking mechanism 124 to lock collars 122A, 122B, 122C in the engaged or disengaged positions or to allow collars 122A, 122B, 122C to move between the engaged or disengaged positions.

Further attention is now directed to FIG. 3, which illustrates a cross-sectional view of the first end of exercise weight system 100. As can be seen, selector 110 is mounted on rod 108 such that selector 110 and rod 108 generally have a common or at least generally parallel axis A. Selector 110 is mounted on rod 108 such that selector 110 can rotate about axis A and relative to rod 108.

In the illustrated embodiment, selector 110 extends over rod 108 at least partially into weight mount 112A such that collars 122A, 122B, 122C are mounted on selector 110. As shown in FIGS. 2 and 3, extending radially out from selector 110 and next to collars 122A, 122B, 122C are pins 130A, 130B, 130C, 130D. Pins 130A, 130B, 130C, 130D are connected to selector 110 (such as by being screwed into selector 110, or being integrally formed therewith) such that the movements of selector 110 and pins 130A, 130B, 130C, 130D are linked. Specifically, as selector 110 is rotated about axis A, pins 130A, 130B, 130C, 130D also rotate about axis A. As will be discussed in greater detail below, rotation of selector 110 and pins 130A, 130B, 130C, 130D about axis A causes collars 122A, 122B, 122C to move generally parallel to axis A between the disengaged and engaged positions to disengage or engage one or more weights 104.

As can be seen in FIG. 3, first end cap 114 is fixedly connected to rod 108 such that first end cap 114 does not substantially move relative to rod 108. Second end cap 116 includes an inner plate 132 and an outer plate 134. Inner plate 132 is fixedly connected to first end cap 114 via braces 120 such that inner plate 132 also does not substantially move relative to rod 108. In contrast, outer plate 134 is mounted on or connected to selector 110 so as to link the movement of outer plate 134 to the movement of selector 110. Thus, as selector 110 is rotated about axis A, outer plate 134 rotates about axis A and relative to inner plate 132 and rod 108.

Locking mechanism 124 is connected to inner plate 132 such that locking mechanism 124 does not rotate about axis A or relative to rod 108. Locking mechanism 124 includes a lock 136 that moves between a locked position and an unlocked position. The unlocked position of lock 136 is illustrated in FIG. 3. Locking mechanism 124 also includes a biasing member 138, such as a spring, that biases lock 136 into the locked position. When lock 136 is in the locked position, lock 136 engages one of a plurality of notches 140 in outer plate 134. The engagement of lock 136 in a notch 140 substantially prevents outer plate 134 and selector 110 from rotating about axis A relative to rod 108, thereby preventing collars 122A-C from moving axially along rod 108. Restricting the movement of collars 122A-C prevents weights 104 from being added to or removed from rod 108. In contrast, when exercise weight bar 102 is positioned in cradle 106 as shown in FIG. 3, locking pin 128 engages lock 136 and moves lock 136 from the locked position to the unlocked position. With lock 136 in the unlocked position, outer plate 134 and selector 110 can be rotated about axis A relative to rod 108, which allows collars 122A-C to move into or out of engagement with weights 104.

Connected to outer plate 134 is a detent 142, such as a spring-loaded ball, press fit ball, extra molded material, or other protrusion, that is biased or extends toward rod 108 so as to engage one of a plurality of recesses 144 disposed around the outer surface of rod 108. As selector 110 and outer plate 134 rotate relative to rod 108, detent 142 moves between and engage recesses 144. Detent 142 and recesses 144 can provide tactile and/or audible feedback to a user as the user rotates selector 110 about rod 108. For instance, detent 142 and recesses 144 can provide an indication of when a weight 104 or a combination of weights 104 have been engaged or disengaged by collars 122A, 122B, 122C. Additionally, the engagement between detent 142 and a recess 144 can also be strong enough to substantially prevent selector 110 from rotating relative to rod 108 during the use of exercise weight bar 102. As discussed above, preventing relative movement between selector 110 and rod 108 prevents weights 104 from being removed from exercise weight bar 102.

Figure 4:
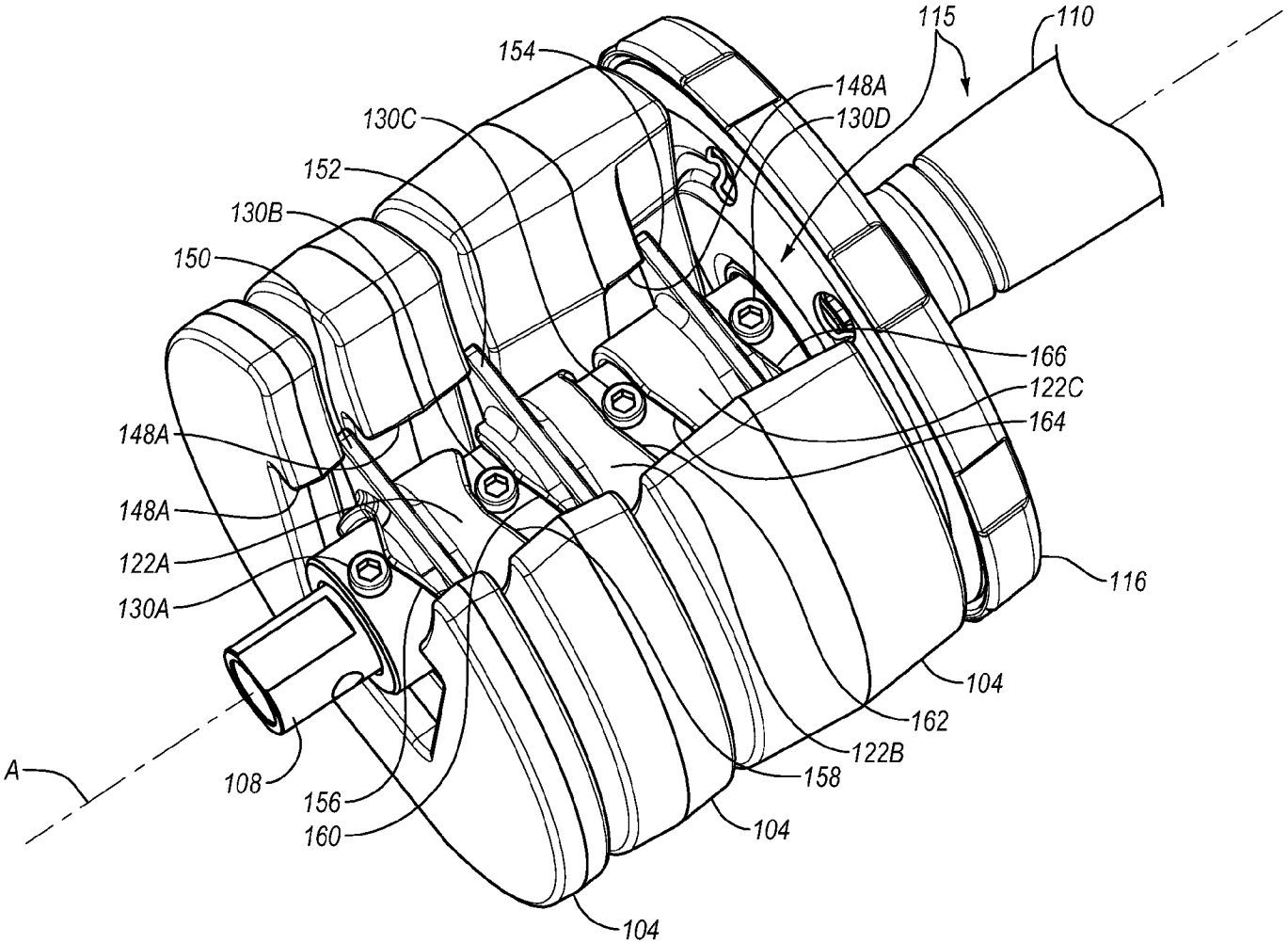
FIG. 4 is a perspective view of a portion of the exercise weight bar and weights of FIG. 1 illustrating an engagement system of the exercise weight bar.

Attention is now directed to FIG. 4, which illustrates a perspective view of the first end of exercise weight bar 102 with some of the components of weight mount 112A removed for convenience of illustration. With regard to FIG. 4, first end cap 114, weight dividers 118A, 118B, and braces 120 have been removed.

Figure 6:
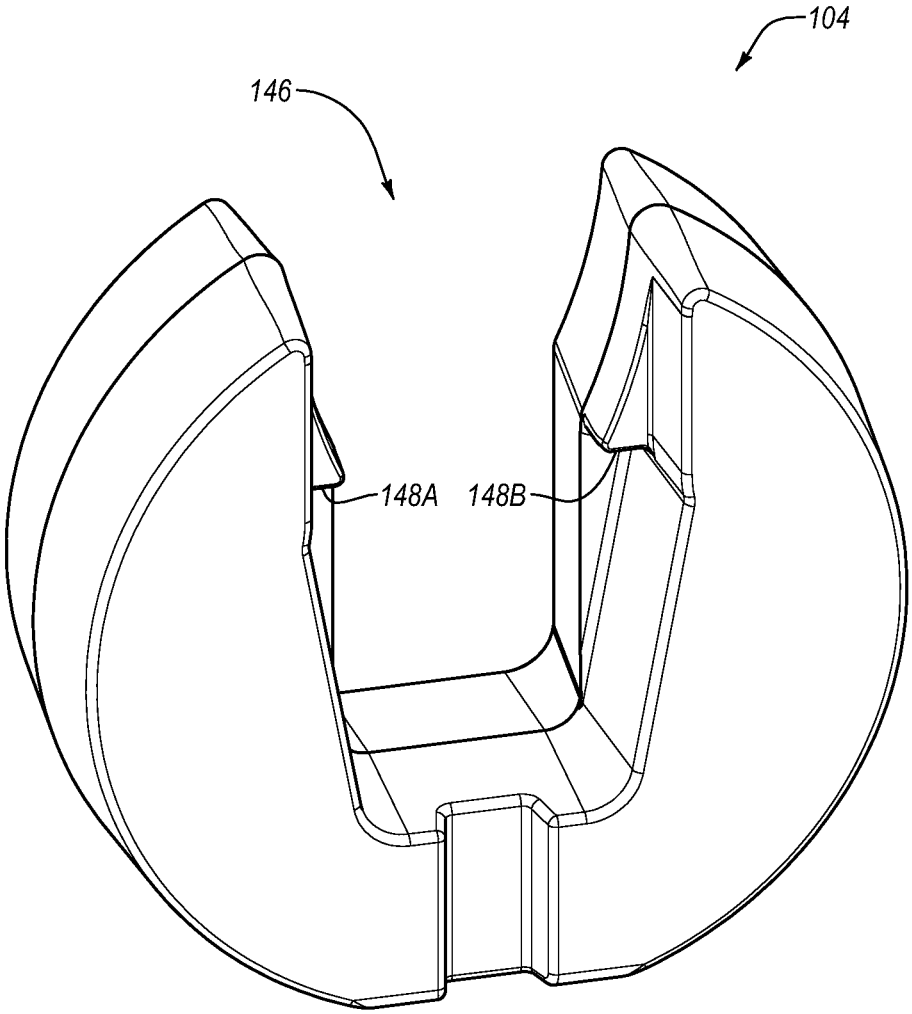
FIG. 6 is a front perspective view of one weight from the exercise weight system of FIG. 1.
Figure 32:
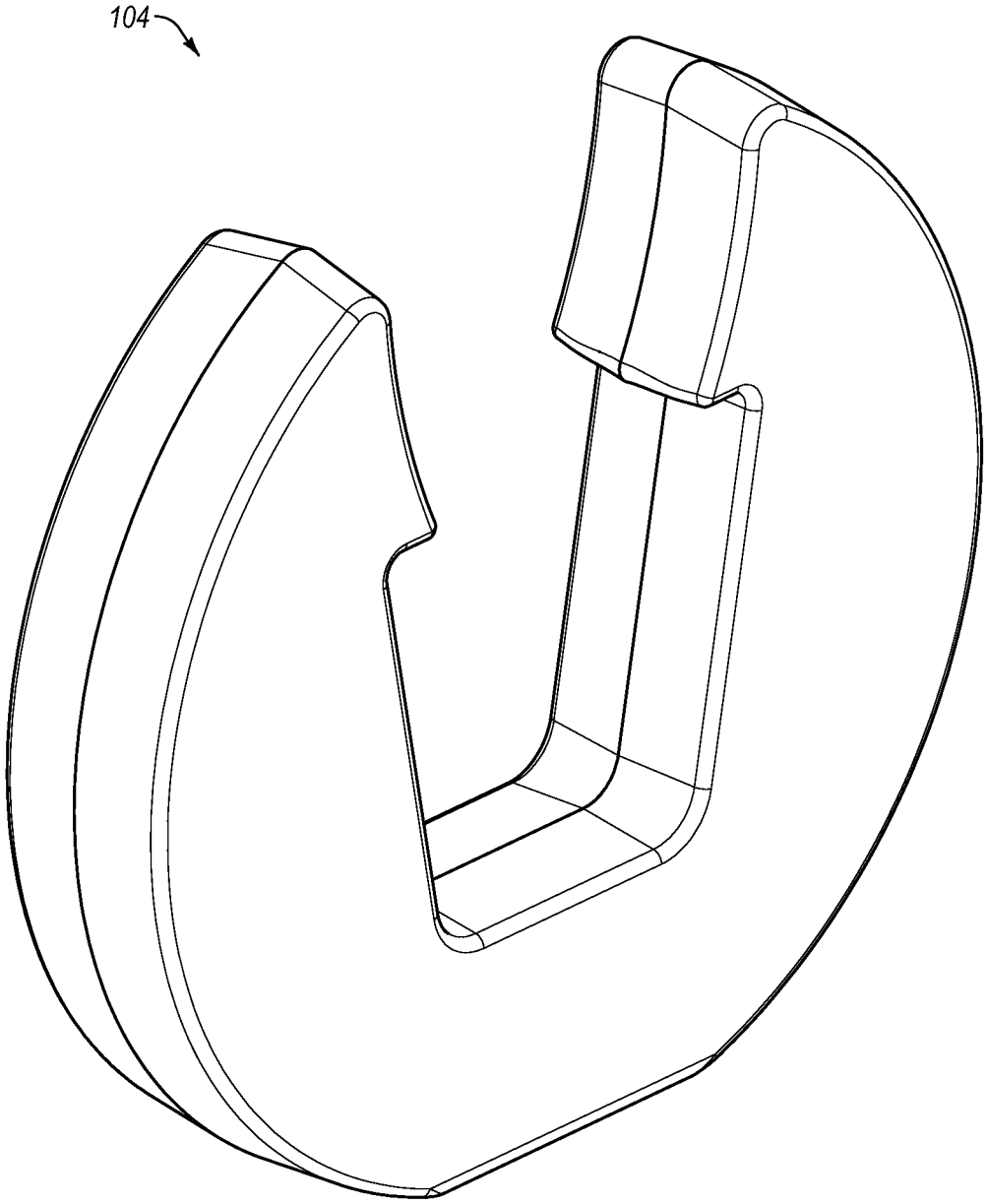
FIG. 32 is a perspective view of one weight of FIG. 1.
Figure 34:
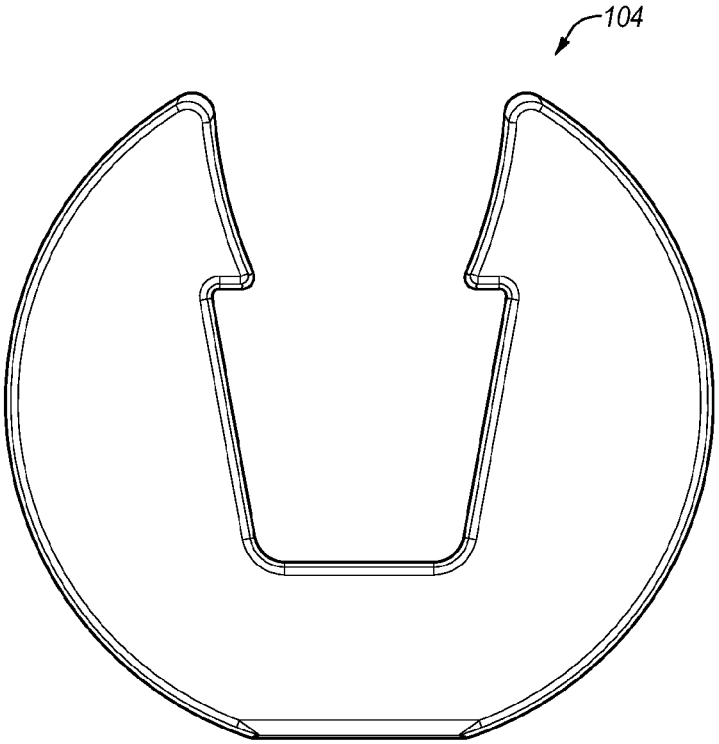
FIG. 34 is a front view of the weight of FIG. 1.
Figure 38:
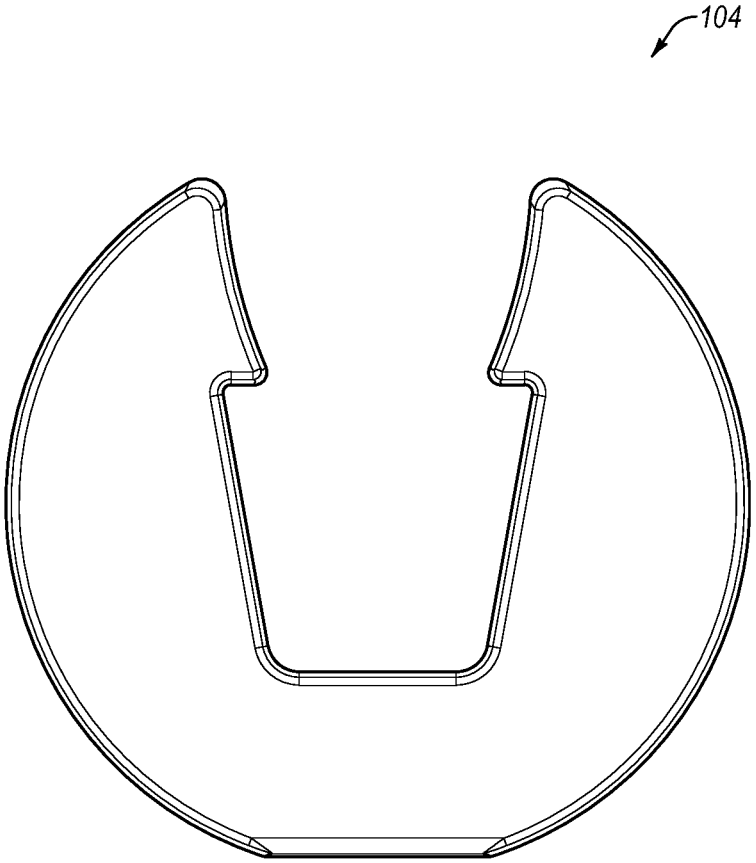
FIG. 38 is a back view of the weight of FIG. 14.

Each of collars 122A, 122B, 122C engage a weight 104 at collar engagement surfaces. For example, as shown in FIG. 6, weight 104 includes a slot 146 that can receive a portion of exercise weight bar 102 therein, such as rod 108 and collars 122A, 122B, 122C. Weight 104 also includes one or more collar engagement surfaces, such as surfaces 148A, 148B. Collar engagement surfaces 148A, 148B are designed to be engaged by at least one of collars 122A, 122B, 122C when collars 122A, 122B, 122C are in the engaged position. As shown in FIG. 6, collar engagement surfaces 148A, 148B can extend partially between opposing sides of weight 104. Alternatively, as shown in FIGS. 32, 34, and 38, collar engagement surfaces 148A, 148B can extend the entire distance between opposing sides of weight 104.

Returning attention to FIG. 4, additional details of collars 122A, 122B, 122C are shown. Collars 122A, 122B, 122C include weight engaging surfaces weight engaging surfaces 150, 152, 154, respectively. Weight engaging surfaces 150, 152, 154 are each designed to engage collar engagement surfaces 148A, 148B on a weight 104 when collars 122A, 122B, 122C are in the engaged position.

Each of collars 122A, 122B, 122C also includes one or more cam surfaces that cooperate with pins 130A, 130B, 130C, 130D to move collars 122A, 122B, 122C into or out of engagement with weights 104. More specifically, collar 122A includes left and right cam surfaces 156, 158; collar 122B includes left and right cam surfaces 160, 162; and collar 122C includes left and right cam surfaces 164, 166. Pins 130A, 130B, 130C, 130D extend up from selector 110 next to cam surfaces 156, 158, 160, 162, 164, 166. Specifically, pin 130A extends up from selector 110 next to cam surface 156; pin 130B extends up from selector 110 next to cam surfaces 158, 160 such that pin 130B is positioned between collars 122A and 122B; pin 130C extends up from selector 110 next to cam surfaces 160, 162 such that pin 130C is positioned between collars 122B and 122C; and pin 130D extends up from selector 110 next to cam surface 164.

Figure 5:
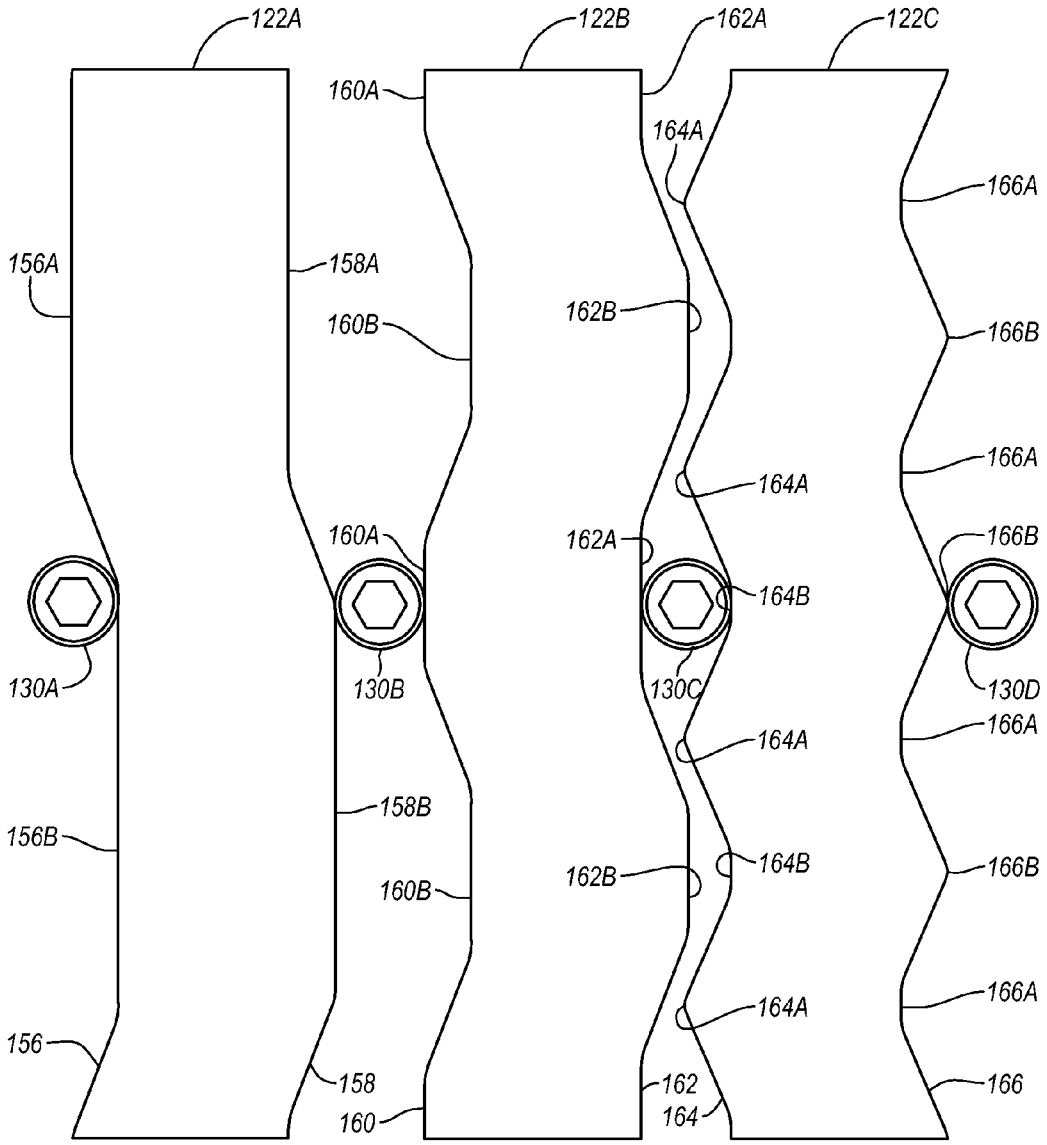
FIG. 5 is a planar view of certain components of the engagement system shown in FIG. 4.

Each of cam surfaces 156, 158, 160, 162, 164, 166 has an alternating pattern and engages at least one of pins 130A, 130B, 130C, 130D. FIG. 5 illustrates one example of patterns for cam surfaces 156, 158, 160, 162, 164, 166. More specifically, FIG. 5 illustrates collars 122A, 122B, 122C in a planar configuration so as to illustrate each of the cam surface patterns.

In the following discussion the use of "right" and "left" designations is intended to provide a general indication of the relative position or movement of the described feature along the length of rod 108. For instance, a feature that is further to the left of another feature is simply positioned axially along rod 108 closer to the left end of rod 108 than the other feature, while a feature that is further to the right of another feature is simply positioned axially along rod 108 closer to the right end of rod 108 than the other feature. Similarly, a feature, such as collars 122A-C, that moves to the left or the right is simply moving along the length of rod 108 closer to the left end or right end, respectively, of rod 108.

Each of the cam surfaces includes one or more high portions and one or more low portions. In the illustrated embodiment, a high portion is a portion of the cam surface that is further to the left than another portion (i.e., closer to the left end of rod 108), and a low portion is a portion of the cam surface that is further to the right than another portion (i.e., closer to the right end of rod 108). Thus, for example, cam surface 156 includes high portion 156A that is positioned axially along rod 108 closer to the left end of rod 108 than low portion 156B.

Pins 130A-D alternatingly engage the high and low portions of cam surfaces 156, 158, 160, 162, 164, 166 as selector 110 is rotated about rod 108. When a pin engages a high portion of a left cam surface, the collar will be in the disengaged position. In contrast, when a pin engages a low portion of a left cam surface, the collar will be in the engaged position. Similarly, when a pin engages a low portion of a right cam surface, the collar will be in the engaged position. In contrast, when a pin engages a high portion of a right cam surface, the collar will be in the disengaged position.

By way of non-limiting example, FIG. 5 illustrates pin 130A engaged with low portion 156B of left cam surface 156 and pin 130B engaged with low portion 158B of right cam surface 158. In this configuration, collar 122A has been moved to the left into the engaged position. In other words, in the view of FIG. 5, collar 122A has been moved along rod 108 to the left such that collar 122A engages a weight 104.

In contrast to collar 122A that is in the engaged position, FIG. 5 illustrates collar 122B in the disengaged position. Pin 130B is shown engaging high portion 160A of left cam surface 160 and pin 130C is shown engaging high portion 162A of right cam surface 162. In this configuration, collar 122B has been moved along rod 108 to the right and into the disengaged position. In other words, in FIG. 5 collar 122B is positioned on rod 108 such that collar 122B does not engage a weight 104. In a manner similar to collar 122A, collar 122C is also illustrated in the engaged position. That is, pins 130C and 130C engage low portions 164B and 166B, respectively, such that collar 122C has been moved along rod 108 to the left to engage a weight 104.

As mentioned, as selector 110 is rotated about rod 108, pins 130A-D also rotate about rod 108. Rotation of pins 130A-D about rod 108 causes pins 130A-D to alternatively engage high and low portions of respective cam surfaces 156, 158, 160, 162, 164, 166, thereby moving collars 122A, 122B, 122C between the engaged and disengaged positions. Because rotation of pins 130A-D causes collars 122A, 122B, 122C to move back and forth axially along rod 108, pins 130A-D can be referred to as cam followers and collars 122A, 122B, 122C and/or cam surfaces 156, 158, 160, 162, 164, 166 may be referred to simply as cams. Thus, an example of an engagement system of the present invention includes a selector, one or more weight engagement members (e.g., such as collars 122A-C), and a cam system. The cam system may include one or more cams and one or more cam followers as described herein. The components of the engagement system are collectively examples of means for moving one or more weight engagement members between first and second positions It is understood that the alternating patterns of cam surfaces 156, 158, 160, 162, 164, 166 illustrated in the Figures are exemplary only. Cam surfaces 156, 158, 160, 162, 164, 166 can be arranged as needed or desired to allow for the selection of any variety of weights 104.

Attention is now directed to FIGS. 7-13, which illustrate another exemplary embodiment of an exercise weight system 200 according to the present invention. Because exercise weight system 200 is similar to exercise weight system 100 in many respects, the following discussion of exercise weight system 200 will focus on the components, features, and functions that are unique to exercise weight system 200.

Figure 7:
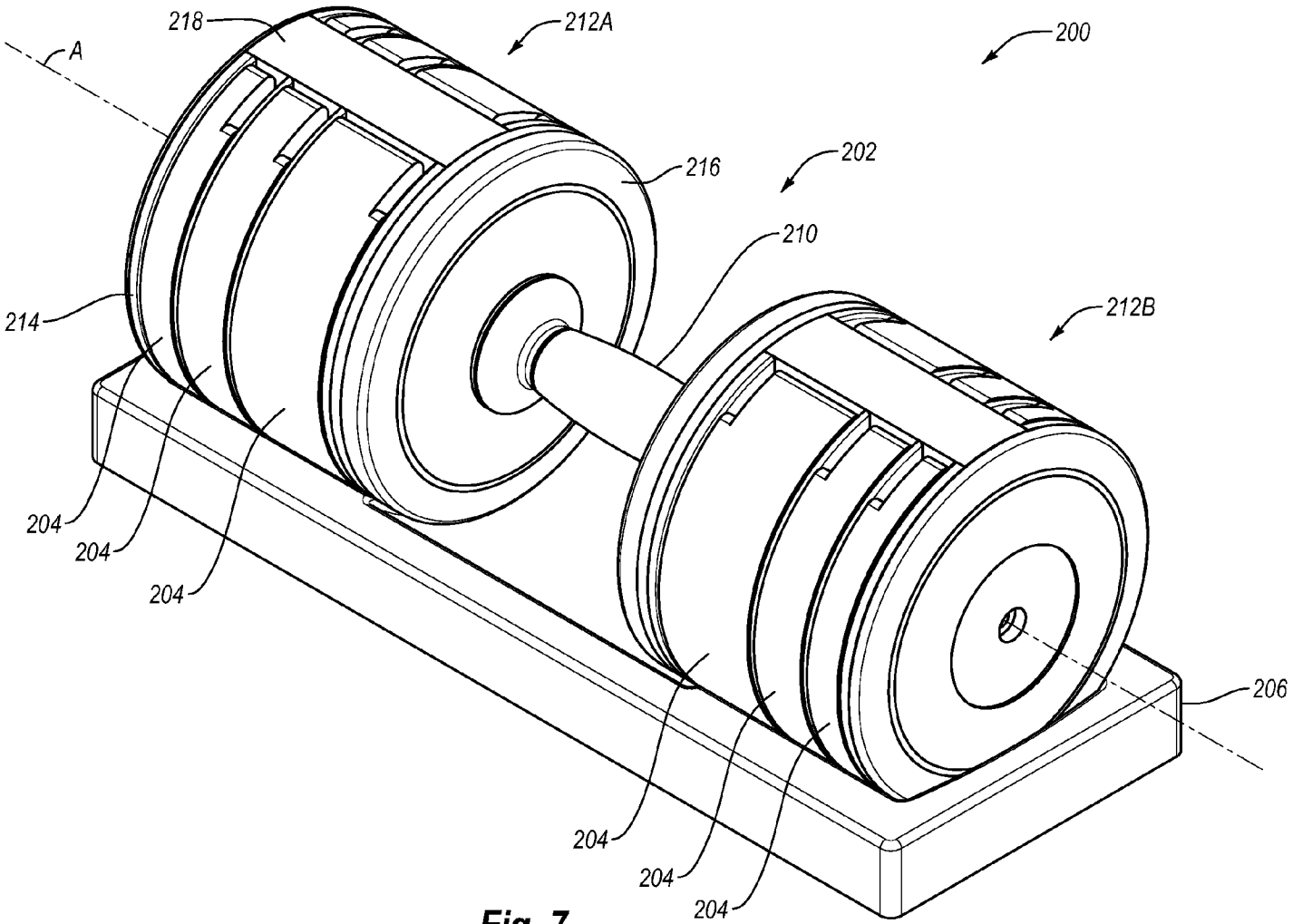
FIG. 7 is a perspective view of an exercise weight system according to another embodiment of the present invention.

As seen in FIG. 7, exercise weight system 200 includes an exercise weight bar 202, a plurality of weights 204, and a cradle 206 designed to hold exercise weight bar 202 and/or plurality of weights 204. Exercise weight bar 202 includes a rod 208 (see FIG. 8) that extends generally between opposing ends of exercise weight bar 202. A selector 210 and weight mounts 212A, 212B are disposed on rod 208. As with the other selectors discussed herein, selector 210 can be used both as a selector device and a grip for holding during exercise. In the illustrated embodiment, weight mount 212A is mounted on a first end of rod 208, weight mount 212B is mounted on a second end of rod 208, and selector 210 is rotatably mounted on rod 208 between weight mounts 212A, 212B. Similar to selector 110, selector 210 may be used to both select and connect weights 204 to bar 208 as well as to hold exercise weight bar 202 during exercise. As shown in FIG. 7, weight mounts 212A, 212B are each designed to receive up to three weights 204. It is understood that weight mounts 212A, 212B may be designed to receive greater or fewer weights 204.

The following discussion will focus primarily on the first end of exercise weight system 200, but it will be equally applicable to the second end thereof. With further reference to FIG. 7, weight mount 212A includes a first end cap 214 and a second end cap 216 as well as weight dividers. First and second end caps 214, 216 and the weight dividers cooperate to define slots for receiving weights 204. First and second end caps 214, 216 and the weight dividers are connected to one another, such as with a brace 218, to substantially prevent movement of weights 204 along the axis A of rod 208.

As shown in FIGS. 8-13, exercise weight bar 202 includes an engagement system 215 designed to selectively and securely connect weights 204 to exercise weight bar 202. Engagement system 215 includes selector 210, a cam group 220 disposed around rod 208, and collars 222A, 222B, 222C disposed about cam group 220. Cam group 220 and selector 210 are integrally formed or connected to one another such that movement of selector 210 causes a corresponding movement by cam group 220. For instance, as selector 210 is rotated about axis A, cam group 220 likewise rotates about axis A.

Collars 222A, 222B, 222C are slidably mounted about cam group 220 such that collars 222A, 222B, 222C can slide between a disengaged position and an engaged position and in a direction that is generally parallel to axis A. When collars 222A, 222B, 222C are in the disengaged position, weights 204 can be received by weight mount 212A. Once one or more weights 204 are received by weight mount 212A, collars 222A, 222B, 222C can be moved to the engaged position to selectively and securely connect one or more of weights 204 to exercise weight bar 202. Thus, collars 222A, 222B, 222C are examples of weight engagement members.

Figure 8:
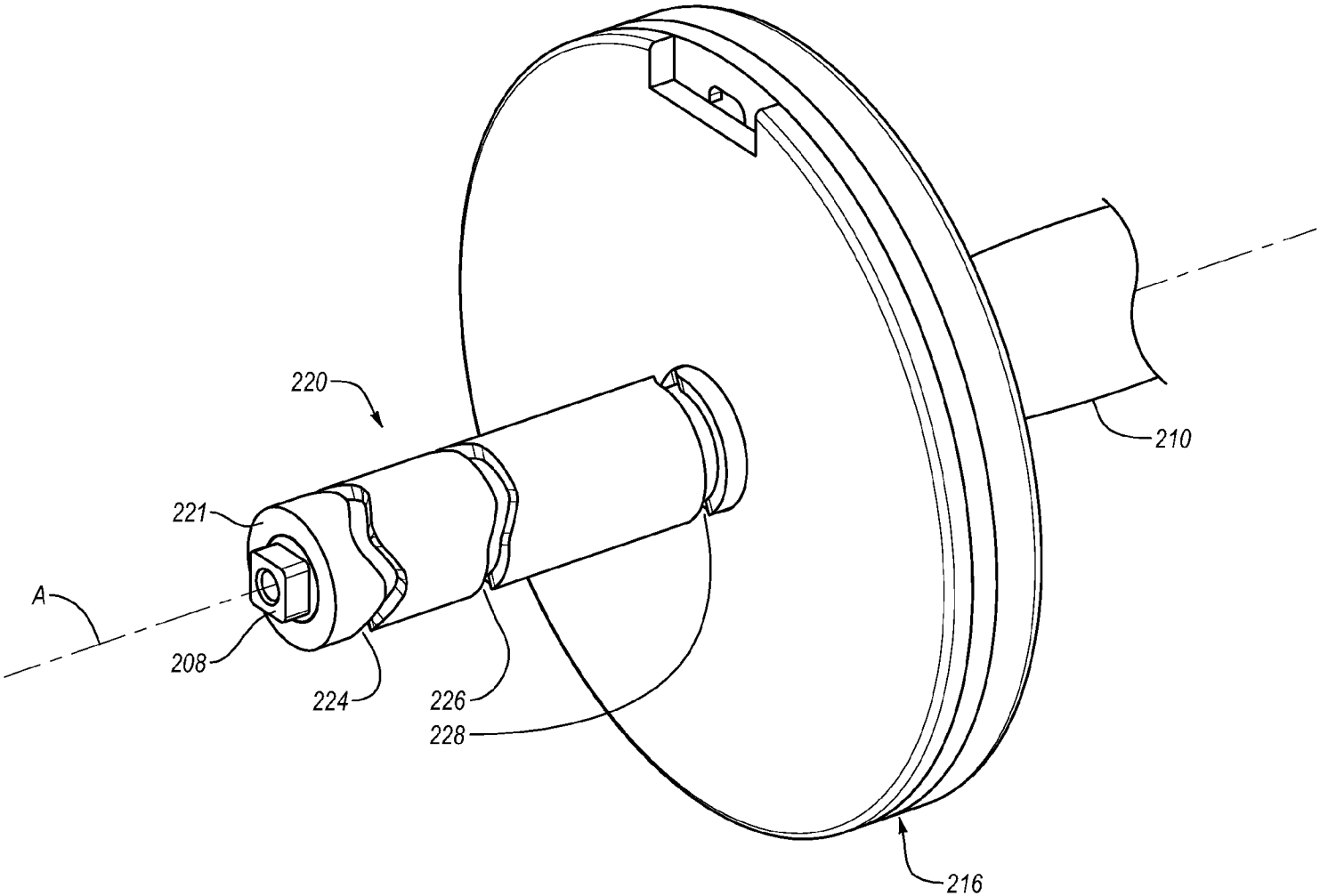
FIG. 8 is a perspective view of a portion of an exercise weight bar of the exercise system of FIG. 7.

As shown in FIG. 8, cam group 220 includes cam grooves 224, 226, 228 that extend at least partially about rod 208. In the illustrated embodiment cam groves 224, 226, 228 are formed in the outer surface of a sleeve 221 that is mounted on rod 208. In this embodiment, sleeve 221 is connected to selector 210 so as to link the movements of selector 210 and cam grooves 224, 226, 228. Sleeve 221 and selector 210 can be connected directly to one another, integrally formed as a unitary piece, or sleeve 221 and selector 210 can both be fixedly mounted on rod 208 so as to link the movements thereof. In other embodiments, cam grooves 224, 226, 228 are formed directly in the outer surface of rod 208, in which case selector 210 is fixedly mounted on rod 208 to link the movements thereof. Similar to cam surfaces 156, 158, 160, 162, 164, 166, each of cam grooves 224, 226, 228 defines a pattern of alternating high and low portions that are respectively further to the left and the right and which facilitate engagement of weights 204.

Figure 9:
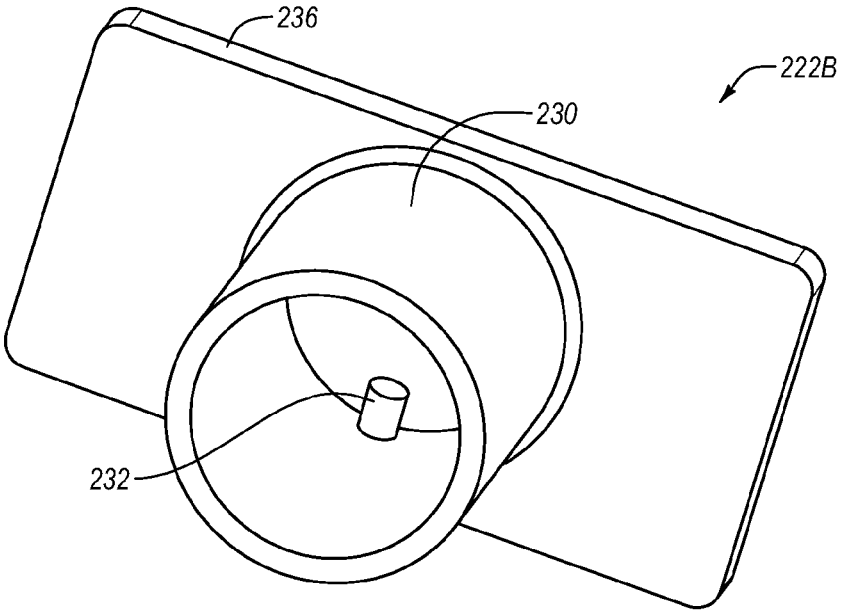
FIG. 9 is a perspective view of a collar of the exercise weight system of FIG. 7.
Figure 10:
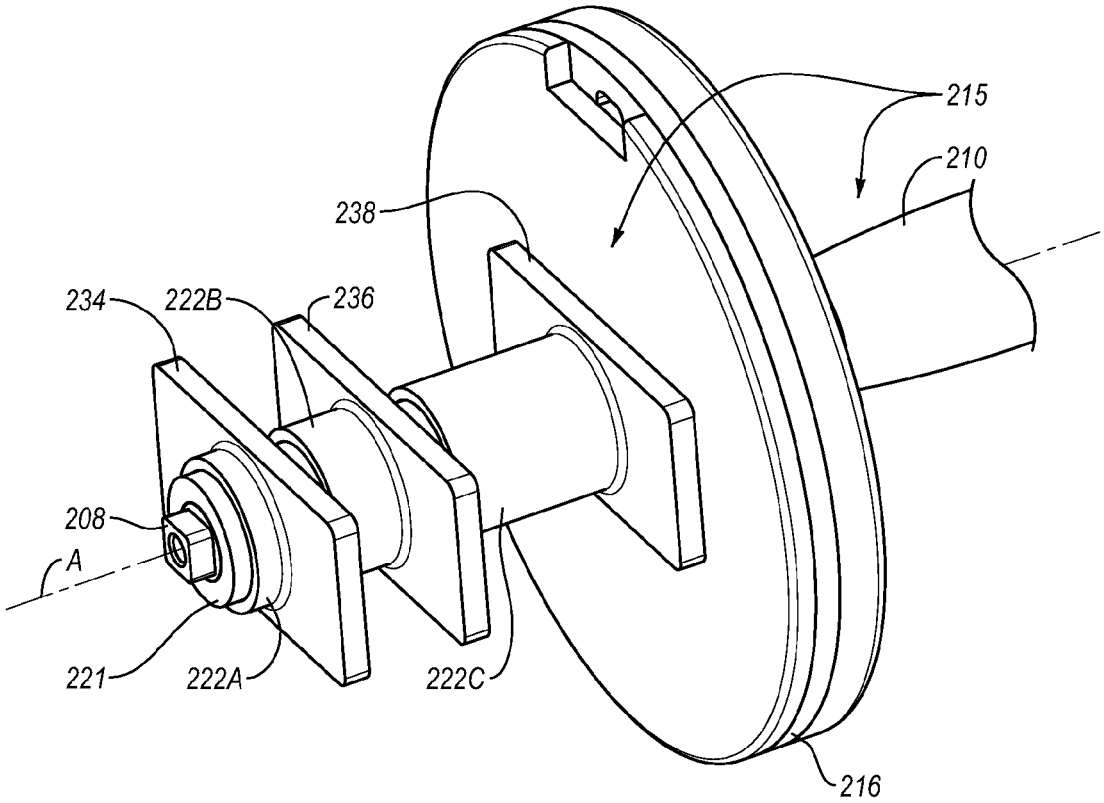
FIG. 10 is a perspective view of a portion of the exercise weight system of FIG. 7 illustrating the collars on the exercise weight bar.
Figure 12:
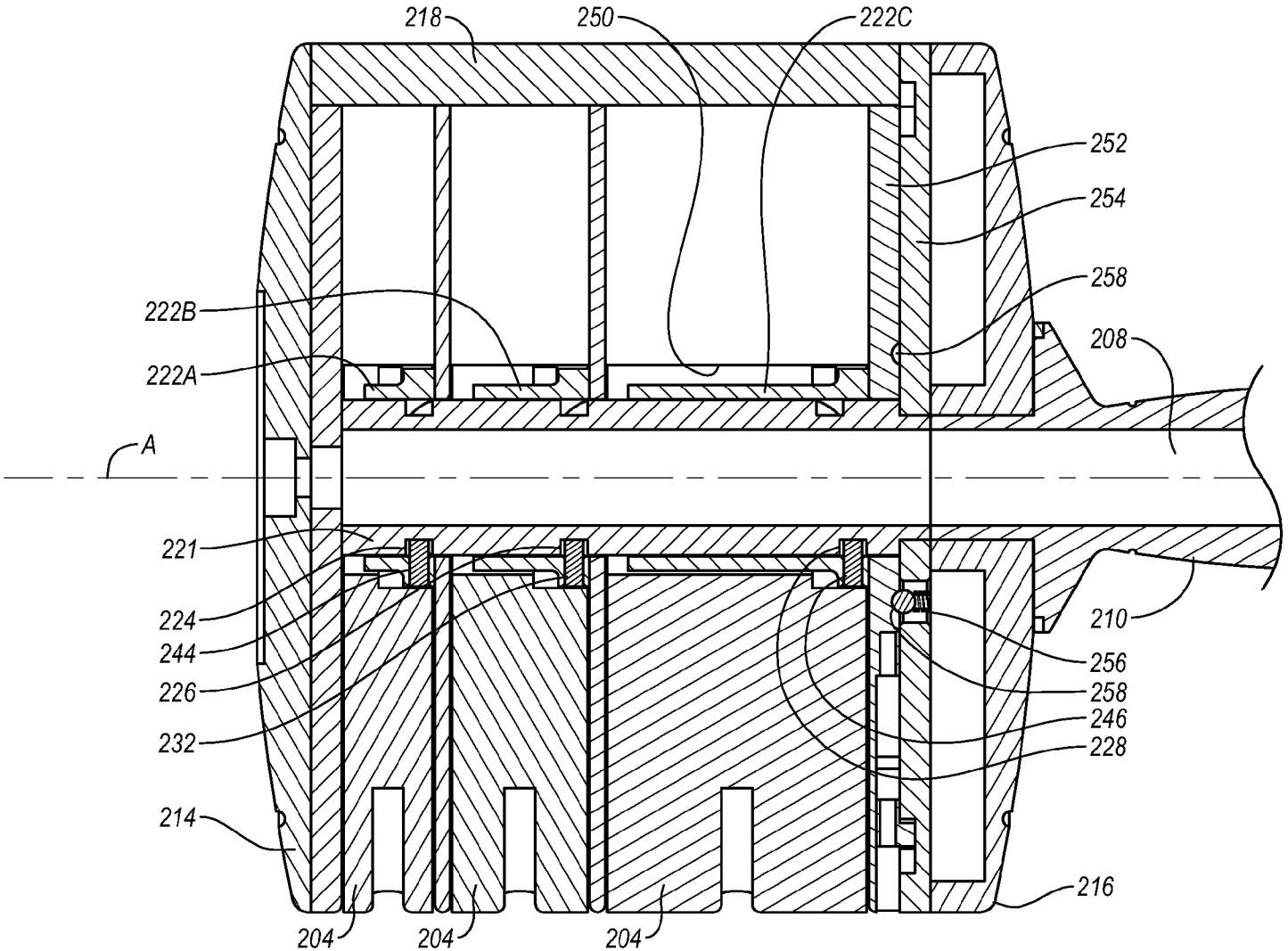
FIG. 12 is a partial cross-sectional view of the exercise weight system of FIG. 7.

FIG. 9 illustrates a perspective view of collar 222B. Collar 222B includes a tubular body 230 that defines an opening for receiving bar 208 therethrough. Extending into the opening in tubular body 230 is a cam pin 232. When collar 222B is mounted on bar 208 as shown in FIGS. 10 and 12, cam pin 232 is received within cam groove 226. As noted above, cam group 220 rotates about axis A when selector 210 is rotated about axis A. When cam group 220 rotates about axis A, cam pin 232 passes through cam groove 226 and moves between the high and low portions in cam groove 226. The movement of cam pin 232 between the high and low portions in cam groove 226 causes collar 222B to move between the engaged and disengaged positions. Collar 222B is in the engaged position when cam pin 232 is in a high portion of cam groove 226. In contrast, collar 222B is in the disengaged position when cam pin 232 is in a low portion of cam groove 226. In the illustrated embodiment of FIG. 10, collars 222A, 222B, 222C are in the engaged position when moved along axis A to the left (i.e., toward the illustrated end of bar 208) and in the disengaged position when moved along axis A to the right (i.e., toward selector 210).

Collars 222A, 222C are similar or identical to collar 222B except that the tubular bodies of collars 222A, 222C are different lengths from one another and from collar 222B. It is understood, however, that collars 222A, 222B, 222C can be formed identically to one another.

Collars 222A, 222B, 222C include weight engagement surfaces 234, 236, 238, respectively. Weight engagement surfaces 234, 236, 238 extend out from the tubular bodies of collars 222A, 222B, 222C and perform at least two functions. First, as shown in FIG. 12, weight engagement surfaces 234, 236, 238 contact a bottom surface 250 of brace 218, which substantially prevents collars 222A, 222B, 222C from rotating about axis A when cam group 220 is rotated thereabout. Second, as discussed in greater detail below, weight engagement surfaces 234, 236, 238 are designed to engage weights 204 when collars 222A, 222B, 222C are in the engaged position.

Figure 11:
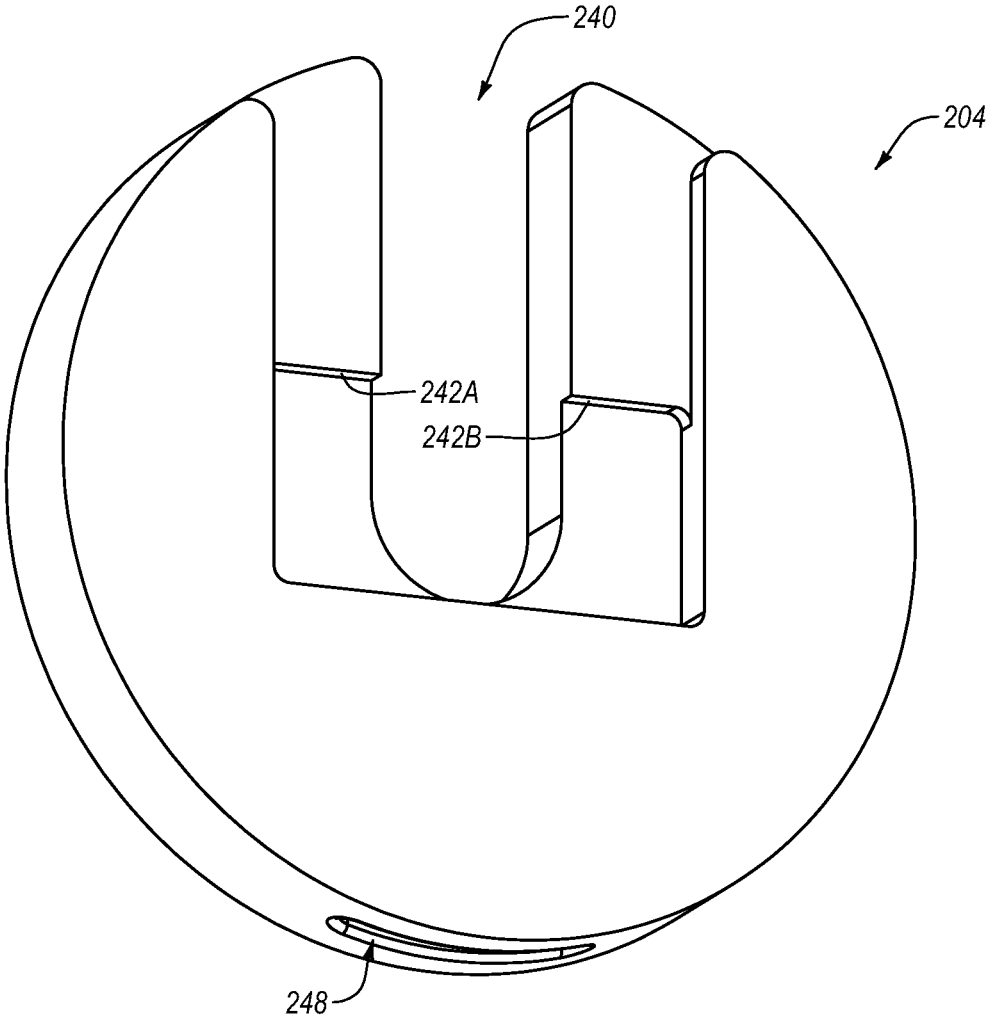
FIG. 11 is a perspective view of one weight from the exercise weight system of FIG. 7.

FIG. 11 illustrates a perspective view of a weight 204 that can be selectively connected to exercise weight bar 202. Weight 204 includes a slot 240 that can receive a portion of exercise weight bar 202 therein, such as rod 208 and collars 222A, 222B, 222C. Weight 204 also includes one or more collar engagement surfaces, such as surfaces 242A, 242B. Collar engagement surfaces 242A, 242B are designed to be engaged by at least one of collars 222A, 222B, 222C when collars 222A, 222B, 222C are in the engaged position. By way of example, when collar 222B is moved from the disengaged position to the engaged position, weight engagement surface 236 will move underneath collar engagement surfaces 242A, 242B so that when exercise weight bar 202 is lifted up weight engagement surface 236 will engage collar engagement surfaces 242A, 242B. As shown in FIG. 11, collar engagement surfaces 242A, 242B can extend partially between opposing sides of weight 204. Alternatively, collar engagement surfaces 242A, 242B can extend the entire distance between opposing sides of weight 204.

Weight 204 also includes a slot 248 formed in the bottom thereof. Slot 248 is designed to receive a corresponding pin or tab (not shown) from cradle 206 when weight 204 is positioned on cradle 206. Slot 248 and the corresponding pin or tab from cradle 206 can cooperate to maintain weight 204 in a substantially vertical manner when weight 204 is positioned on cradle 206.

FIG. 12 illustrates a cross-sectional view of the first end of exercise weight bar 204 assembled with weights 204 positioned thereon. More specifically, selector 210 and sleeve 221 are mounted on rod 208 and collars 222A, 222B, 222C are mounted on sleeve 221 with cam pins 244, 232, 246 extending into cam grooves 224, 226, 228. As discussed above, rotation of selector 210 about axis A causes cam grooves 224, 226, 228 also to rotate about axis A, which in turn causes collars 222A, 222B, 222C to move between the engaged and disengaged positions.

Exercise weight system 200 includes a feedback mechanism for providing an indication to a user that one or more weights 204 have been engaged or disengaged. The feedback mechanism of exercise weight system 200 is similar to the detent and recess system discussed above in connection with exercise weight system 100. Specifically, second end cap 216 includes an inner plate 252 and an outer plate 254. Inner plate 252 is fixedly connected to first end cap 214 via brace 218 such that inner plate 252 also does not substantially rotate about axis A. In contrast, outer plate 254 is mounted on or connected to selector 210 so as to link the movement of outer plate 254 to the movement of selector 210. Thus, as selector 210 is rotated about axis A, outer plate 254 rotates about axis A and relative to inner plate 252.

Connected to outer plate 254 is a detent 256, such as a spring-loaded ball, press fit ball, extra molded material, or other protrusion, that is biased or extends toward inner plate 252 so as to engage one of a plurality of recesses 258 formed in the surface of inner plate 252. As selector 210 and outer plate 254 rotate about axis A, detent 256 moves between and engage recesses 258. Detent 256 and recesses 258 can provide tactile and/or audible feedback to a user as the user rotates selector 210 about axis A. For instance, detent 256 and recesses 258 can provide an indication of when a weight 204 or a combination of weights 204 have been engaged or disengaged by collars 222A, 222B, 222C. Additionally, the engagement between detent 256 and a recess 258 can also be strong enough to substantially prevent outer plate 254 from rotating relative to inner plate 252 during the use of exercise weight bar 202. Preventing relative movement between inner and outer plates 252, 254 prevents selector 210 from rotating and moving collars 222A, 222B, 222C between the engaged and disengaged positions.

Figure 13:
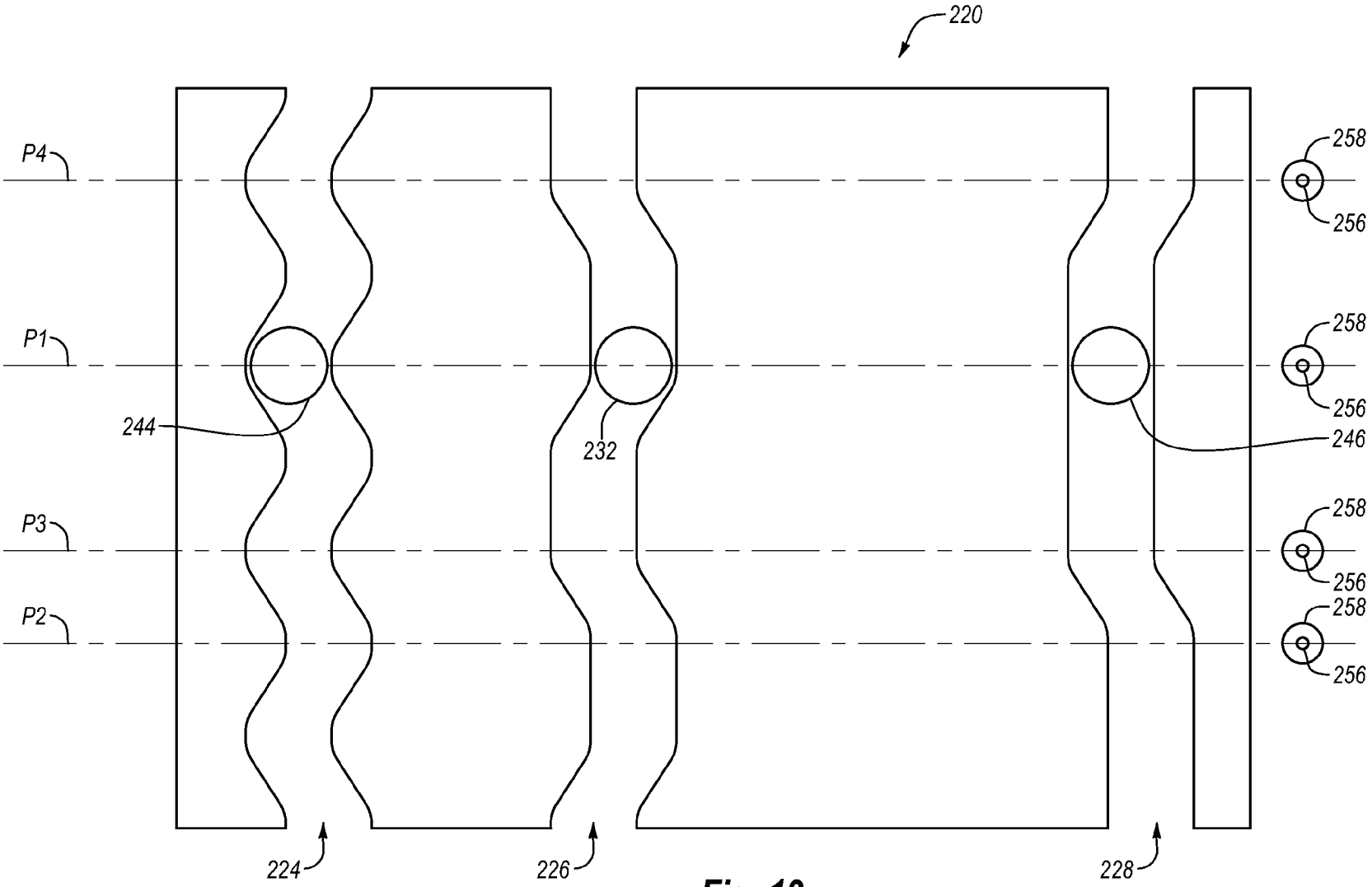
FIG. 13 is a planar view of cam grooves shown in FIG. 8.

As noted above, each of cam grooves 224, 226, 228 defines an alternating pattern between high and low portions to cause collars 222A, 222B, 222C to move between the engaged and disengaged positions as selector 210 is rotated about axis A. FIG. 13 illustrates a planar view of cam group 220 to show the pattern of each of cam grooves 224, 226, 228 and their relative positioning one to another. These patterns and relative positioning of cam grooves 224, 226, 228 enables several combinations of weights 204 to be selectively connected to exercise weight bar 202.

FIG. 13 illustrates four example positions P1, P2, P3, P4 of cam group 220 that will, when aligned with cam pins 244, 232, 246 of collars 222A, 222B, 222C, provide four different weight combinations for exercise weight bar 202. That is, when cam group 220 is rotated about axis A so that one of positions P1-P4 is aligned with cam pins 244, 232, 246, each of collars 222A, 222B, 222C will be moved either into the engaged or disengaged position.

For instance, when cam group 220 is rotated about axis A so that position P1 is aligned with cam pins 244, 232, 246 as shown, collar 222A associated with cam pin 244 will be in the engaged position, collar 222B associated with cam pin 232 will be in the disengaged position, and collar 222C associated with cam pin 246 will be in the engaged position. When collars 222A, 222C are in the engaged position, two weights 204 will be connected to exercise weight bar 202.

When cam group 220 is rotated about axis A so that position P2 is aligned with pins 244, 232, 246, collars 222A, 222B, 222C will all be moved to the disengaged position. As a result, no weights 204 will be connected to exercise weight bar 202. In contrast, rotating cam group 220 about axis A so that position P3 is aligned with pins 244, 232, 246 will cause collars 222A, 222B, 222C to each move to the engaged position, thereby engaging three weights 204. When cam group 220 is rotated so that position P4 is aligned with pins 244, 232, 246, collars 222A, 222B will be moved into the engaged position while collar 222C will be in the disengaged position. It is understood that the illustrated and described positions P1-P4 are exemplary only and that cam group 220 can be rotated so that other portions of cam grooves 224, 226, 228 can be aligned with pins 244, 232, 246 to engage various other combinations of weights 204.

As depicted in FIG. 13, detent 256 and recesses 258 are positioned so as to engage one another when specific portions of cam grooves 224, 226, 228 are aligned with cam pins 244, 232, 246. For instance, detent 256 and recesses 258 are positioned so that whenever cam pins 244, 232, 246 are aligned with one of positions P1-P4 shown in FIG. 13, detent 256 will engage a recess 258. The engagement between detent 256 and recesses 258 provides tactile or audible feedback to the user that one or more weights 204 have been secured to exercise weight bar 202 and that exercise weight bar 202 is ready for use.

Thus, an example of an engagement system of the present invention comprises selector 210, cam group 220, one or more collars, such as collars 222A, 222B, 222C, and a cam system. The cam system comprises one or more cams, such as cam grooves 224, 226, 228, and one or more cam follower surfaces, such as pins 232, 244, 246. The components of the engagement system, including pins 232, 244, 246, collars 222A-C, cam grooves 224, 226, 228, and selector 210, are collectively examples of means for moving one or more weight engagement members between first and second positions.

Weight mount 212A can include a locking mechanism similar or identical to locking mechanism 124 described above to prevent collars 222A, 222B, 222C from moving between the disengaged and engaged positions when exercise weight bar 202 is removed from cradle 206. The locking mechanism could be released when exercise weight bar 202 is positioned on cradle 206 to allow selector 210 and cam group 220 to rotate about axis A so that collars 222A, 222B, 222C can be moved between the engaged and disengaged positions. The locking mechanism can also be designed to prevent selector 210 and cam group 220 from moving relative to other components of exercise weight bar 202 when exercise weight bar 202 is removed from cradle 206 to prevent collars 222A, 222B, 222C from moving between the engaged and disengaged positions when exercise weight bar 202 is not in cradle 206.

Attention is now directed to FIGS. 14-20, which illustrate still yet another exemplary embodiment of an exercise weight system 300 according to the present invention. Because exercise weight system 300 is similar to exercise weight systems 100 and 200 in many respects, the following discussion of exercise weight system 300 will focus on the components, features, and functions that are unique to exercise weight system 300.

Figure 14:
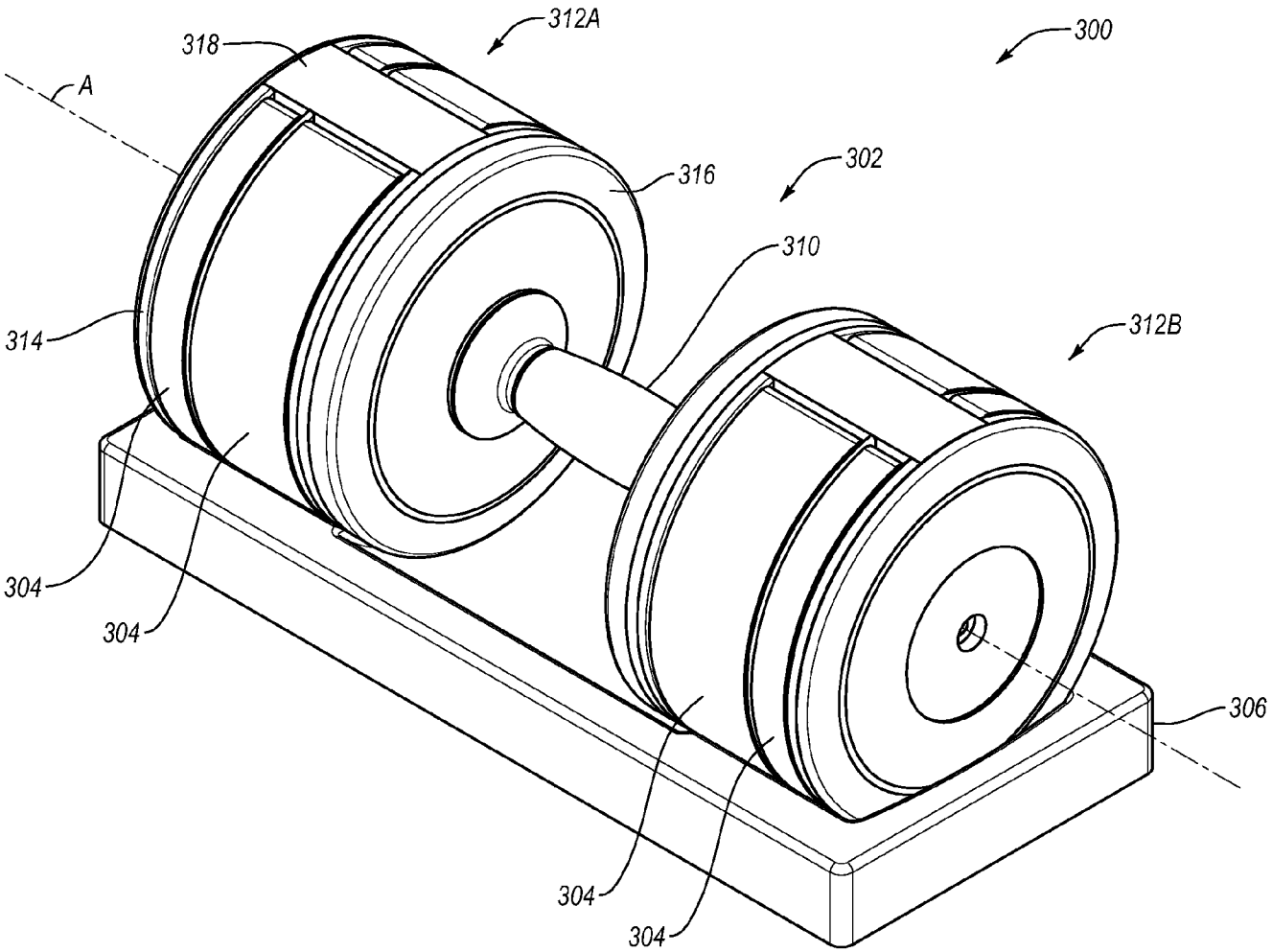
FIG. 14 is a perspective view of an exercise weight system according to yet another embodiment of the present invention.

As seen in FIG. 14, exercise weight system 300 includes an exercise weight bar 302, a plurality of weights 304, and a cradle 306 designed to hold exercise weight bar 302 and/or plurality of weights 304. Exercise weight bar 302 includes a rod 308 (see FIG. 33) that extends generally between opposing ends of exercise weight bar 302. A selector 310 and weight mounts 312A, 312B are disposed on rod 308. As with the other selectors discussed herein, selector 310 can be used both as a selector device and a grip for holding during exercise. In the illustrated embodiment, weight mount 312A is mounted on a first end of rod 308, weight mount 312B is mounted on a second end of rod 308, and selector 310 is mounted on rod 308 between weight mounts 312A, 312B. Selector 310 is rotatably mounted on rod 308 such that selector 310 is able to rotate about axis A and relative to rod 308. As shown in FIG. 14, weight mounts 312A, 312B are each designed to receive up to two weights 304. It is understood that weight mounts 312A, 312B may be designed to receive greater or fewer weights 304.

With further reference to FIG. 14, weight mount 312A includes a first end cap 314 and a second end cap 316. First and second end caps 314, 316 cooperate to at least partially define one or more slots for receiving weights 304. First and second end caps 314, 316 are connected to one another with a brace 318.

Figure 15:
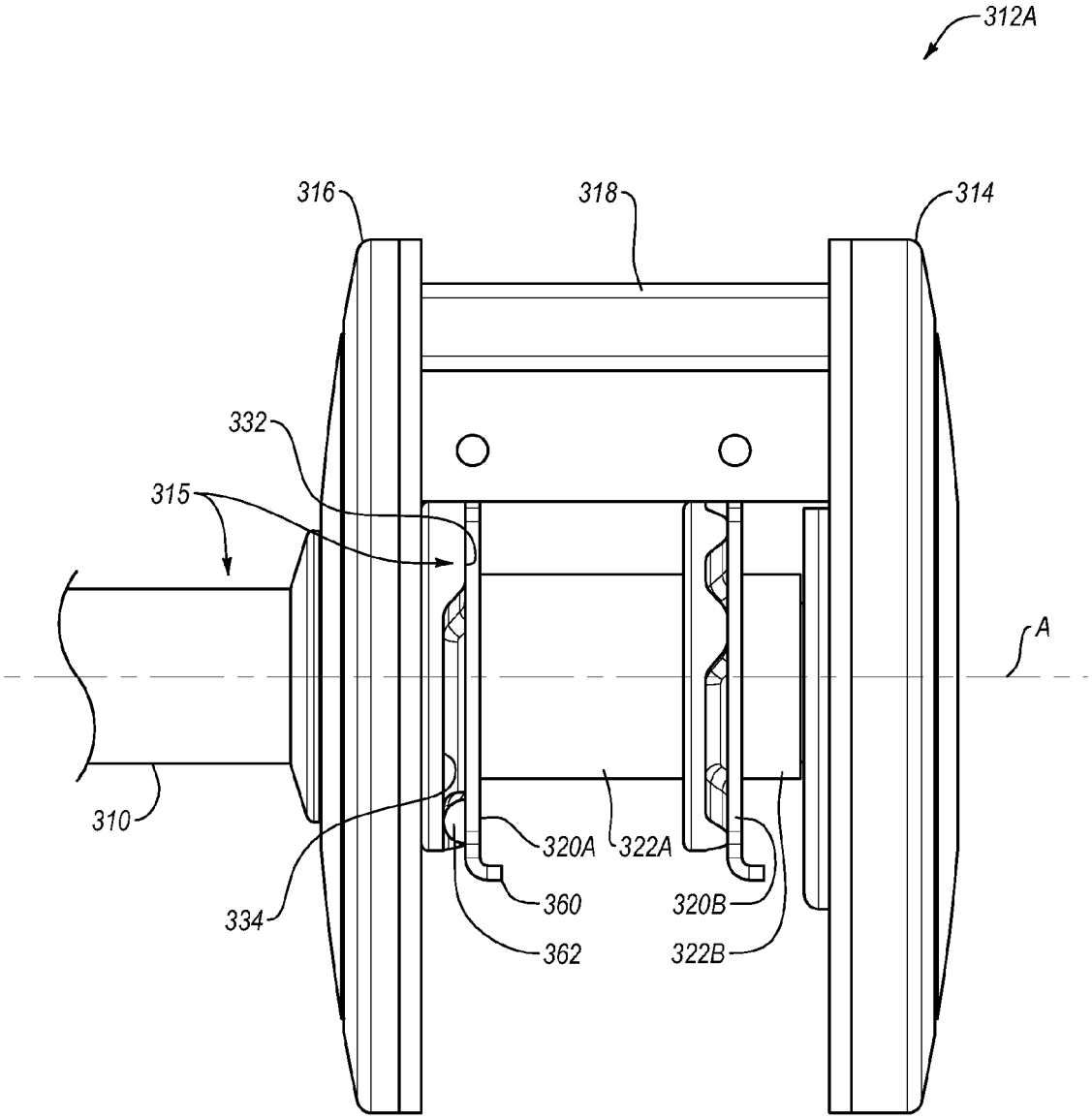
FIG. 15 is a side view of a portion of the exercise weight system of FIG. 14.

As shown in FIG. 15, exercise weight bar 302 includes an engagement system 315 designed to selectively and securely connect weights 304 to exercise weight bar 302. Engagement system 315 includes selector 310, weight engagement members 320A, 320B and collars 322A, 322B. Weight engagement members 320A, 320B are connected to brace 318, and collars 322A, 322B are mounted about rod 308. Collars 322A, 322B are mounted about rod 308 such that movement of selector 310 causes a corresponding movement by collars 322A, 322B. For instance, like exercise weight system 100, selector 310 extends into weight mount 312A and collars 322A, 322B are fixedly mounted on selector 310 so as to link the movement of selector 310 and collars 322A, 322B.

The rotation of collars 322A, 322B causes weight engagement members 320A, 320B to selectively move, pivot, or flex between a disengaged position and an engaged position. Weight engagement members 320A, 320B are connected to brace 318 such that weight engagement members 320A, 320B are able to selectively move, pivot, or flex between the disengaged position and the engaged position. For instance, each of weight engagement members 320A, 320B may have a first end pivotally connected to brace 318 so as to allow a second end to pivot between the disengaged and engaged positions. In other embodiments, the first end of each of weight engagement members 320A, 320B may be rigidly or fixedly connected to brace 318, while portions of weight engagement members 320A, 320B are able to bend or flex to allow the second ends of weight engagement members 320A, 320B to move (e.g., bend or flex) between the disengaged and engaged positions.

When weight engagement members 320A, 320B are in the disengaged position, weights 304 can be received by weight mount 312A. Once one or more weights 304 are received by weight mount 312A, weight engagement members 320A, 320B can be moved, pivoted, or flexed to the engaged position to selectively and securely connect one or more of weights 304 to exercise weight bar 302. The movement of weight engagement members 320A, 320B between the disengaged and engaged positions is in a direction that is generally parallel to or at least partially along longitudinal axis A of rod 308.

Figure 16:
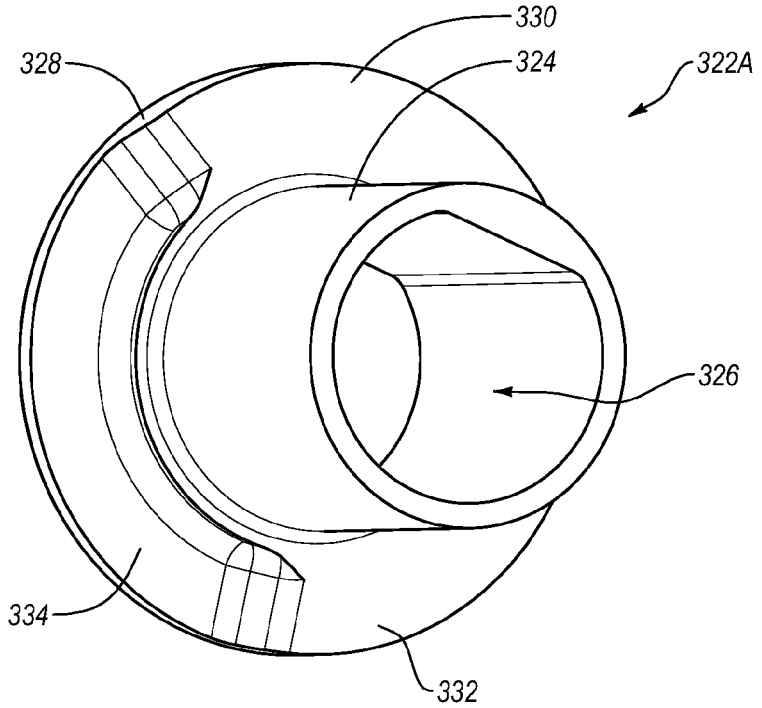
FIG. 16 is a perspective view of a collar of the exercise weight system of FIG. 14.
Figure 20:
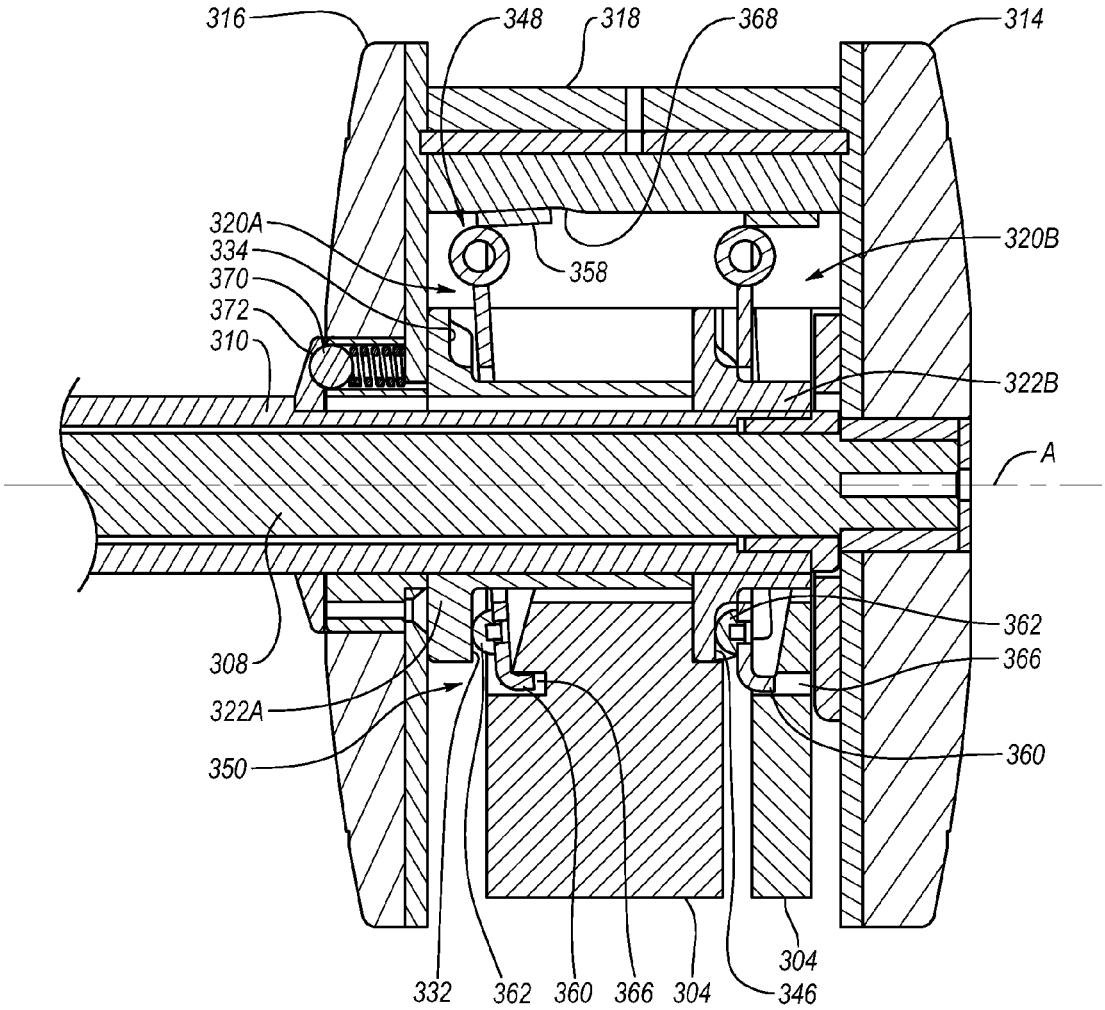
FIG. 20 is a partial cross-sectional view of the exercise weight system of FIG. 14.

FIG. 16 illustrates a perspective view of collar 322A. Collar 322A includes a tubular body 324 that defines an opening 326 for receiving rod 308 and a portion of selector 310 therethrough. Collar 322A also includes a rim 328 that extends radially out from tubular body 324. Rim 324 defines or includes a cam surface 330 that includes high portion 332 and low portion 334. As shown in FIGS. 15 and 20, high portion 332 is positioned further away from selector 310 than low portion 334. In other words, high portion 332 is aligned with one position or location along the length of rod 308 while low portion 334 is aligned with a second position or location along the length of rod 308.

Figure 17:
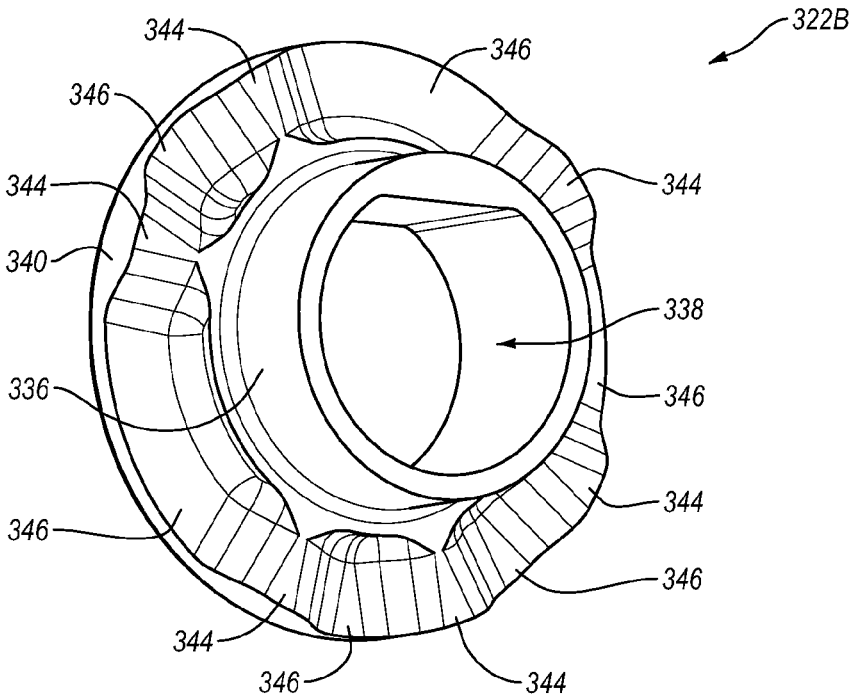
FIG. 17 is a perspective view of another collar of the exercise weight system of FIG. 14.

FIG. 17 illustrates a perspective view of collar 322B. Collar 322B includes a tubular body 336 that defines an opening 338 for receiving rod 308 and a portion of selector 310 therethrough. Collar 322B also includes a rim 340 that extends radially out from tubular body 336. Rim 340 defines or includes a cam surface 342 that includes a plurality of high portions 344 and a plurality of low portions 346. As can be seen in FIG. 17, cam surface 342 alternates between high and low portions 344, 346. According to the present embodiment, high portions 344 are positioned further away from selector 310 than low portions 346 when collar 322B is mounted on rod 308. That is, like high and low portions 332, 334, high portions 344 are aligned with one position or location along the length of rod 308 while low portions 346 are aligned with a second position or location along the length of rod 308.

The widths of high and low portions 344, 346 are not necessarily, but may be, equal or uniform. For instance, the width of one low portion 346 (e.g., the distance between two radially adjacent high portions 344) may be greater or smaller than the width of another low portion 346. Similarly, the width of one high portion 344 (e.g., the distance between two radially adjacent low portions 346) may be greater or smaller than the width of another high portion 344. Furthermore, high and low portions 344, 346 of collar 322B may be axially aligned with or offset from high and low portions 332, 334 of collar 322A. Aligning and/or offsetting high and low portions of collars 322A, 322B allows for the selection and securement of a variety of weight 304 combinations. It is understood that the alternating patterns of high and low portions 332, 334, 344, 346 illustrated in the Figures are exemplary only. Cam surfaces 330, 342 can be arranged as needed or desired to allow for the selection of any variety of weights 304.

Figure 18:
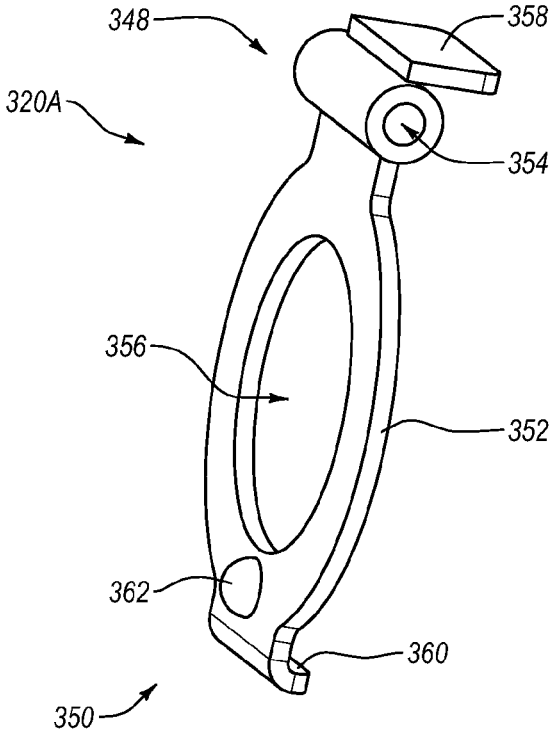
FIG. 18 is a perspective view of a weight engagement member of the exercise weight system of FIG. 17.

Attention is now directed to FIG. 18, which illustrates a perspective view of weight engagement member 320A, which is substantially similar or identical to weight engagement member 320B. Weight engagement member 320A includes a first end 348, a second end 350, and a central body portion 352. As mentioned above, first end 348 can be connected to brace 318 in either a pivoting or rigid manner. For instance, first end 348 can be formed with a generally circular aperture 354 extending therethrough. A rod, bolt, or other device may extend out of opposing ends of aperture 354 and into opposing walls of brace 318 so as to connect weight engagement member 320A to brace 318. Aperture 354 and the rod received therein may be designed to allow weight engagement member 320A to rotate or pivot about the rod. Alternatively, opposing sides of first end 348 may be received in or extend through opposing walls of brace 318 so that weight engagement member 320A may pivot as described herein. Additionally, first end 348 may also be rigidly connected to brace 318 using a mechanical fastener (e.g., bolts, claims, pins), welding, gluing, or the like. In such case, central body portion 352 may bend or flex to allow second end 350 to move between the disengaged and engaged positions.

Central body portion 352 includes an aperture 356 for receiving therethrough rod 308 and tubular body 324 of collar 322A. Weight engagement member 320A also includes a biasing member 358 that, as discussed below, engages or interacts with brace 318 to bias weight engagement member 320A to the disengaged position. In the illustrated embodiment, biasing member 358 is integrally formed as part of or is connected to first end 348. Biasing member 358 may take any suitable form, including resilient materials, springs, and the like.

Second end 350 of weight engagement member 320A includes a weight catch 360 and a detent 362. Weight catch 360 is designed to engage a weight 304 when weight engagement member 320A is moved, pivoted, or flexed into the engaged position. Detent 362 is designed to interact with cam surface 330 of collar 322A to cause weight engagement member 322A to move, pivot, or flex between the disengaged and engaged positions.

As collar 320A rotates about axis A, high and low portions 332, 334 of cam surface 330 will alternatingly engage detent 362. When high portion 332 engages detent 362, weight engagement member 320A will move, pivot, or flex to the engaged position, while weight engagement member 320A will move, pivot, or flex to the disengaged position when low portion 334 engages detent 362. Thus, detent 362 can be referred to as a cam follower because its movement follows the high and low portions of cam surface 330. Detent 362 can be a spring-loaded ball, press fit ball, extra molded material, or other protrusion, that extends from weight engagement member 320A toward cam surface 330.

Figure 19:
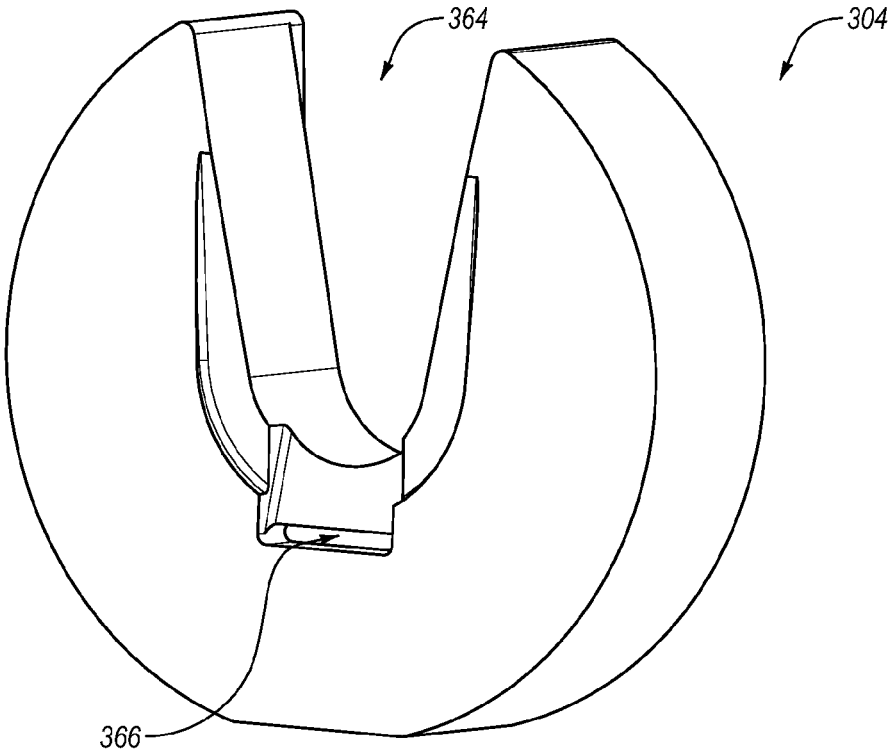
FIG. 19 is a perspective view of one weight from the exercise weight system of FIG. 17.

FIG. 19 illustrates a perspective view of a weight 304 that can be selectively connected to exercise weight bar 302. Weight 304 includes a slot 364 that can receive a portion of exercise weight bar 302 therein, such as rod 308, weight engagement members 320A, 320B, and/or collars 322A, 222B. Weight 304 also includes a catch channel 366 that is designed to receive at least a portion of weight catch 360 when weight engagement member 320A or 320B is in the engaged position. As shown in FIG. 19, catch channel 366 can extend partially between opposing sides of weight 304. Alternatively, catch channel 366 can extend the entire distance between opposing sides of weight 304.

FIG. 20 illustrates a partial cross-sectional view of exercise weight system 300 showing one weight 304 engaged by weight engagement member 320A while the other weight 304 is not engaged by weight engagement member 320B. In the illustrated embodiment, selector 310 has been rotated about axis A, thereby causing a corresponding rotation by collars 322A, 322B. As shown, collar 322A is positioned so that detent 362 of weight engagement member 320A is engaged with a high portion 332 of collar 320A and detent 362 of weight engagement member 320B is engaged with a low portion 346 of collar 320B. As a result of these engagements, second end 350 of weight engagement member 320A has been moved into the engaged position so as to engage left weight 304, while second end 350 of weight engagement member 320B is in the disengaged position (thus, not engaging right weight 304). More specifically, second end 350 of weight engagement member 320A has been pivoted or flexed to the right sufficiently far to cause weight catch 360 to engage catch channel 366 of left weight 304, while second end 350 of weight engagement member 320B has not been pivoted or flexed to the right sufficiently to cause weight catch 360 to engage catch channel 366 of right weight 304.

As shown in FIG. 20, when weight engagement member 320A is moved into the engaged position, biasing member 358 is pressed against a bottom surface 368 of brace 318. This interaction between biasing member 358 and surface 368 biases weight engagement member 320A toward the disengaged positions. Nevertheless, biasing member 358 and/or surface 368 may be designed to allow weight engagement member 320A to pivot to the engaged position, as shown in FIG. 20. For instance, in the illustrated embodiment, surface 368 is formed of a resilient material (e.g., rubber, foam, or the like) that can be compressed as shown in FIG. 20 by biasing member 358 when weight engagement member 320A is pivoted to the engaged position. However, when detent 362 engages a low portion 334 on collar 322A, the resilient nature of surface 368 biases or forces weight engagement member 320A to move or pivot to the disengaged position. Alternatively, surface 368 may be generally rigid and biasing member 358 may be formed of a resilient material that biases weight engagement member 320A to the disengaged position.

As shown in FIG. 20, exercise weight system 300 includes a feedback mechanism for providing an indication to a user that one or more weights 304 have been engaged or disengaged. The feedback mechanism of exercise weight system 300 is similar to that of exercise weight system 200. Specifically, second end cap 316 is fixedly connected to rod 308 via brace 318 and first end cap 314 such that second end cap 316 does not substantially rotate relative to rod 308. As noted above, selector 310 rotates relative to rod 308 in order to move weight engagement members 320A, 320B between the engaged and disengaged positions. Thus, selector 310 rotates relative to second end cap 316.

Connected to second end cap 316 is a detent 370, such as a spring-loaded ball, press fit ball, extra molded material, or other protrusion, that is biased or extends toward selector 310 so as to engage one of a plurality of recesses 372 formed in the surface of selector 310. As selector 310 rotates about rod 308, detent 370 moves between and engage recesses 372. Detent 370 and recesses 372 provide tactile and/or audible feedback to a user as the user rotates selector 310, indicating when a weight 304 or a combination of weights 304 have been engaged or disengaged by weight engagement members 320A, 320B. Additionally, the engagement between detent 370 and recesses 372 can also be strong enough to substantially prevent selector 310 from rotating relative to second end cap 316 during the use of exercise weight bar 302, thereby preventing weights 304 from being removed from exercise weight bar 202 during exercise.

As noted above, cam surfaces 330, 342 define alternating patterns of high and low portions that cause weight engagement members 320A, 320B to move between the engaged and disengaged positions as selector 310 is rotated about axis A. The alternating patterns and relative positioning of the high and low portions on collars 320A, 320B enables several combinations of weights 304 to be selectively connected to exercise weight bar 302. It is understood that the alternating patterns of cam surfaces 330, 342 illustrated in the Figures are exemplary only. Cam surfaces 330, 342 can be arranged as needed or desired to allow for the selection of any variety of weights 304.

In light of the disclosure herein, it will be understood that the components of engagement system 315 are examples of means for moving one or more weight engagement members between first and second positions.

Weight mount 312A can include a locking mechanism similar or identical to locking mechanism 124 described above to prevent weight engagement members 320A, 320B from moving between the disengaged and engaged positions when exercise weight bar 302 is removed from cradle 306. The locking mechanism could be released when exercise weight bar 302 is positioned on cradle 306 to allow selector 310 and collars 322A, 322B to rotate so that weight engagement members 320A, 320B can be moved between the engaged and disengaged positions. The locking mechanism can also be designed to prevent selector 310 and collars 322A, 322B from moving relative to other components of exercise weight bar 302 when exercise weight bar 302 is removed from cradle 306, thereby preventing weight engagement members 320A, 320B from moving between the engaged and disengaged positions when exercise weight bar 302 is not in cradle 306.

Figure 21:
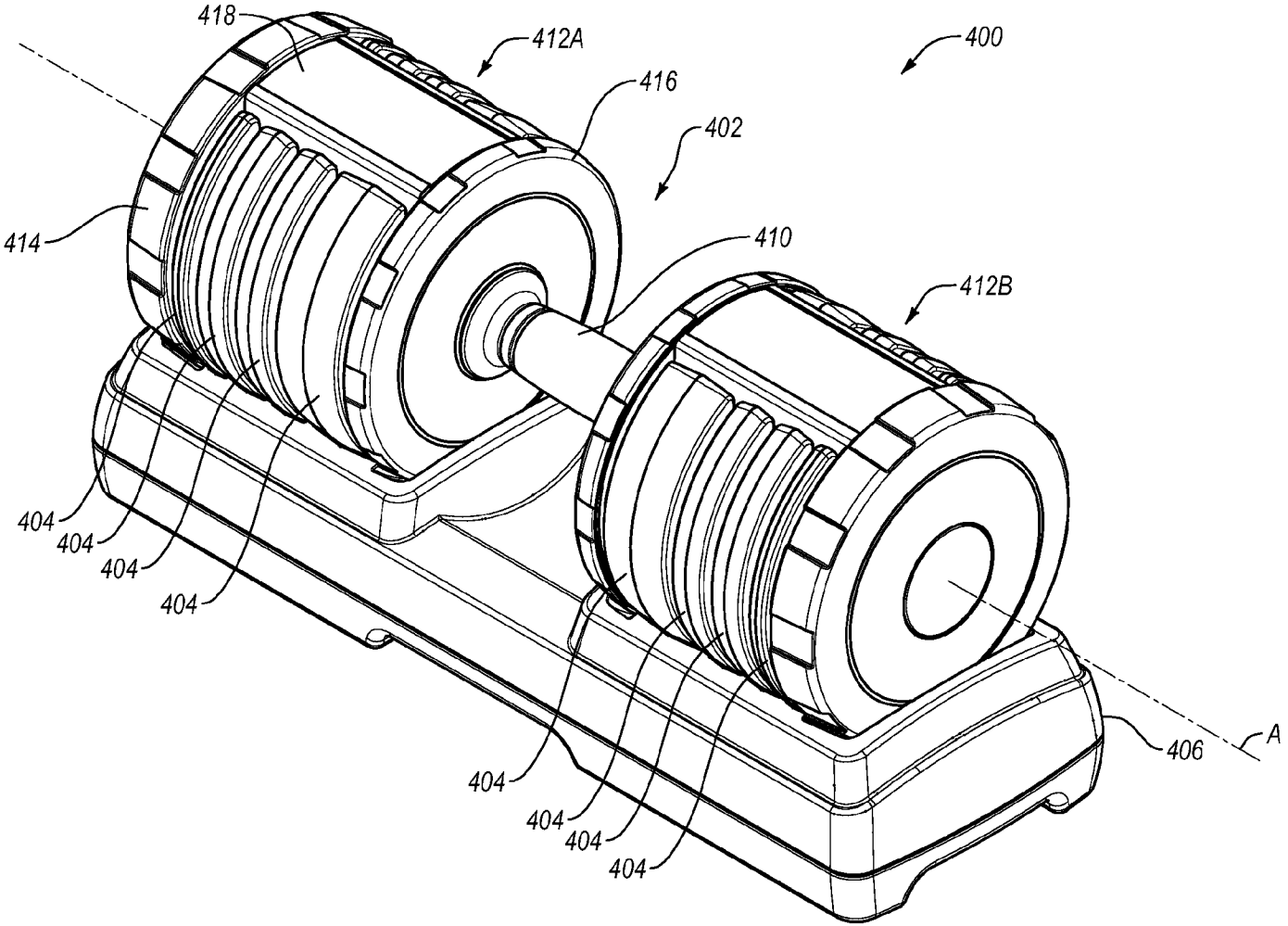
FIG. 21 is a perspective view of an exercise weight system according to still yet another embodiment of the present invention.
Figure 22:
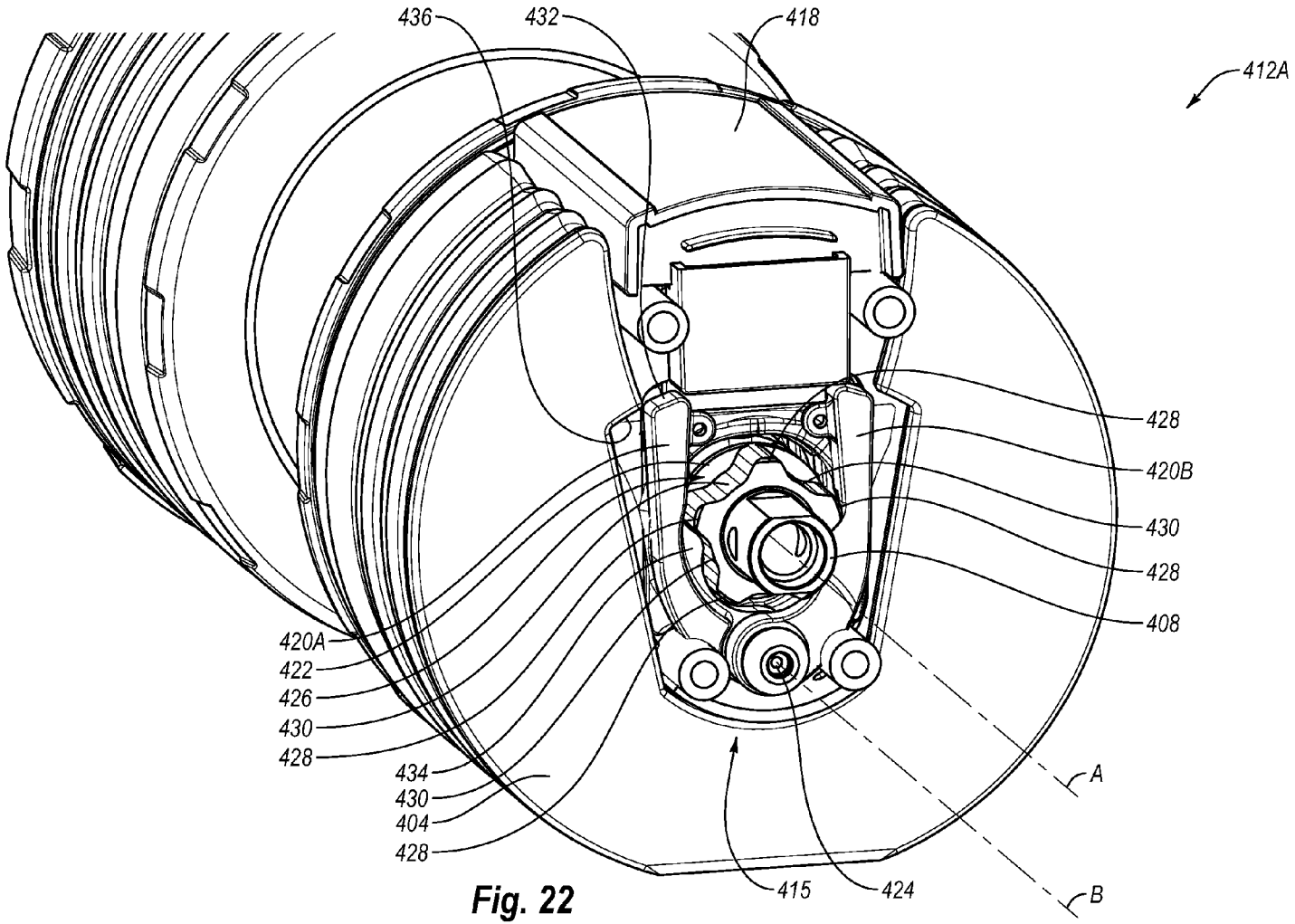
FIG. 22 is an end perspective view of a portion of the exercise weight system of FIG. 21.
Figure 23:
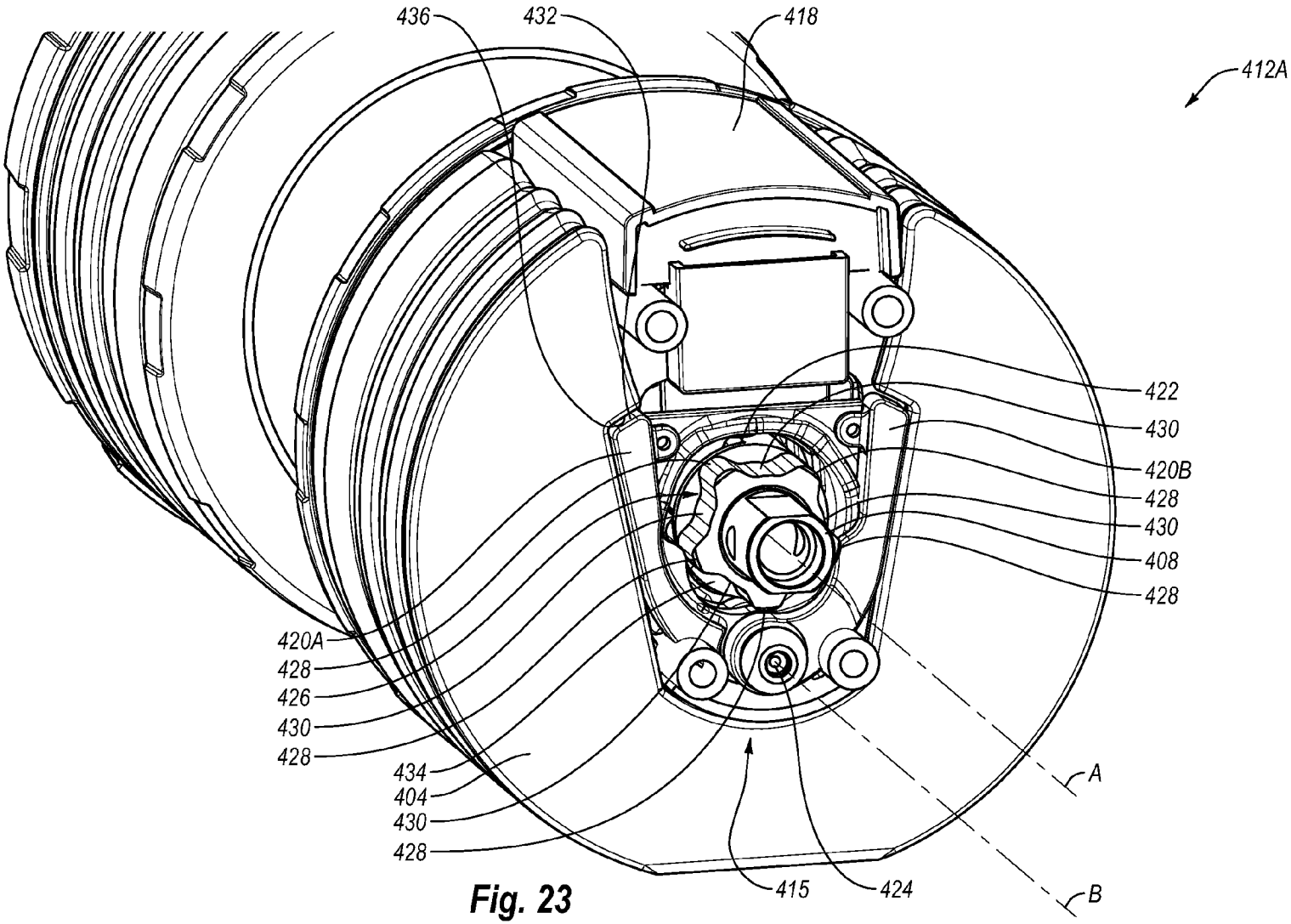
FIG. 23 is another end perspective view of a portion of the exercise weight system of FIG. 21.

Attention is now directed to FIGS. 21-23, which illustrate still another exemplary embodiment of an exercise weight system 400 according to the present invention. Because exercise weight system 400 is similar to exercise weight systems 100, 200, and 300 in many respects, the following discussion of exercise weight system 400 will focus on the components, features, and functions that are unique to exercise weight system 400.

As seen in FIG. 21, exercise weight system 400 includes an exercise weight bar 402, a plurality of weights 404, and a cradle 406 designed to hold exercise weight bar 402 and/or plurality of weights 404. Exercise weight bar 402 includes a rod 408 (see FIGS. 22-23) that extends generally between opposing ends of exercise weight bar 402. Rod 408 has a longitudinal axis A that extends between opposing ends thereof. A selector 410 and weight mounts 412A, 412B are disposed on rod 408. Selector 410 is movably mounted on rod 408 such that selector 410 can rotate about longitudinal axis A and relative to rod 408. As with the other selectors discussed herein, selector 410 can be used both as a selector device and a grip for holding during exercise. In the illustrated embodiment, weight mount 412A is mounted on a first end of rod 408, weight mount 412B is mounted on a second end of rod 408, and selector 410 is mounted on rod 408 between weight mounts 412A, 412B. As shown in FIG. 21, weight mounts 412A, 412B are each designed to receive up to four weights 404. It is understood that weight mounts 412A, 412B may be designed to receive greater or fewer weights 404.

Weight mount 412A includes a first end cap 414 and a second end cap 416 as well as weight dividers. First and second end caps 414, 416 and the weight dividers cooperate to at least partially define slots for receiving weights 404. First and second end caps 414, 416 and the weight dividers are connected to one another, such as with a brace 418, to substantially prevent movement of weights 404 along the axis A of rod 408.

As shown in FIGS. 22-23, weight mount 412A includes an engagement system 415 designed to selectively and securely connect weights 404 to exercise weight bar 402. Engagement system 415 includes selector 410, one or more weight engagement members, and one or more collars. One or more of the weight engagement members are associated with each weight 404 and can be selectively moved into and out of engagement with weights 404 to selectively engage or disengage weights 404. In the illustrated embodiment, two weight engagement members 420A, 420B, embodied here as calipers, are illustrated as being associated with the weight 404 that is positioned adjacent to the first end of rod 408. While not illustrated, each of the other weights 404 also has two weight engagement members associated therewith. It is understood that each weight 404 may have a single weight engagement member associated therewith, or may have three or more weight engagement members associated therewith.

Weight engagement members 420A, 420B are mounted on a bar 424 that is connected between first and second end caps 414, 416 of weight mount 412A. Weight engagement members 420A, 420B are mounted on bar 424 such that weight engagement members 420A, 420B can pivot or rotate thereabout between a disengaged position and an engaged position. For instance, each of weight engagement members 420A, 420B may have a first end pivotally connected to bar 424 so as to allow a second end to pivot or rotate between the disengaged and engaged positions. In other embodiments, the first end of each of weight engagement members 420A, 420B may be rigidly or fixedly connected to bar 424, while portions of weight engagement members 420A, 420B are able to bend or flex to allow the second ends of weight engagement members 420A, 420B to move between the disengaged and engaged positions. Weight engagement members 420A, 420B move closer to and further away from rod 408 as weight engagement members 420A, 420B move between the disengaged and engaged positions.

In the illustrated embodiment, bar 424 has a longitudinal axis B that is generally parallel to longitudinal axis A of rod 408. As a result, weight engagement members 420A, 420B pivot or rotate about an axis (i.e., axis B) that is generally parallel to longitudinal axis A. Thus, in the illustrated embodiment, the movement of weight engagement members 420A, 420B between the disengaged and engaged positions is generally within planes that are generally perpendicular to longitudinal axis A.

As noted above, engagement system 415 also includes one or more collars. While the illustrated embodiment includes a single collar 422, it is understood that multiple collars could be employed in the present invention. Collar 422 is mounted on rod 408 such that movement of selector 410 causes a corresponding movement by collar 422. For instance, selector 410 may be connected to or integrally formed with collar 422 so as to link the movement of selector 410 and collar 422 such that as selector 410 is rotated about axis A, collar 422 likewise rotates about axis A. As discussed below, the rotation of collar 422 about axis A causes weight engagement members 420A, 420B to selectively pivot or rotate between the disengaged position and the engaged position. When the weight engagement members are in the disengaged position, weights 404 can be received by weight mount 412A. Once one or more weights 404 are received by weight mount 412A, the weight engagement members can be pivoted or rotated to the engaged position to selectively and securely connect one or more of weights 404 to exercise weight bar 402.

FIGS. 22-23 illustrate perspective views of a portion of collar 422. Collar 422 defines an opening for receiving rod 408 therethrough. Collar 422 also includes a cam surface 426 that includes high portions 428 and low portions 430. As shown in FIGS. 22-23, high portions 428 are positioned radially further away from rod 408 than low portions 430. Although not shown, collar 422 also includes one or more additional cam surfaces, each with one or more high and low portions. Each of the additional cam surfaces can be associated with one or more weight engagement members, which in turn are associated with one or more weights. Thus, while this discussion focuses on cam surface 426, weight engagement members 420A, 420B, and the end weight 404, it is understood that each weight 404 is associated with one or more weight engagement members and one or more cam surfaces. It is also understood that the various weight engagement members and cam surfaces may be disposed axially along the length of rod 408 so as to be aligned or otherwise associated with one or more weights 404.

The widths of high and low portions 428, 430 are not necessarily, but may be, equal or uniform. For instance, the width of one low portion 430 (e.g., the distance between two radially adjacent high portions 428) may be greater or smaller than the width of another low portion 430. Similarly, the width of one high portion 428 (e.g., the distance between two radially adjacent low portions 430) may be greater or smaller than the width of another high portion 428. Similarly, the high and low portions of the other cam surfaces of collar 422 may have various patterns that are different from cam surface 426 or from one another. Furthermore, the high and low portions of the various cam surfaces may be axially aligned with or offset from the high and low portions of the other cam surfaces. As discussed herein, aligning and/or offsetting high and low portions of the cam surfaces allows for the selection and securement of a variety of weight 404 combinations to exercise weight bar 402. It is understood that the high and low portions of the various cam surfaces of collar 422 can be arranged as needed or desired to allow for the selection of any variety of weights 404.

As can be seen in FIGS. 22-23, weight engagement members 420A, 420B are substantially similar or identical to one another. As mentioned above, weight engagement member 420A includes a first end that is movably mounted on bar 424 so that a second end can pivot or rotate between the disengaged and engaged positions. Weight engagement member 420A can also include a biasing member that biases weight engagement member 420A to the disengaged position. The biasing member may be a resilient member, such as a coil spring, connected between weight engagement member 420A and bar 424. Alternatively, the biasing member may be a resilient member, such as a spring, rubber cord, or the like, that is connected between the second end of weight engagement member 420A and the second end of weight engagement member 420B. When connected therebetween, the biasing member may bias the second ends of weight engagement members 420A, 420B closer together and into the disengaged position.

The second end of weight engagement member 420A includes a weight engagement surface 432. Weight engagement surface 432 is designed to engage a caliper engagement surface 436 on weight 404 when weight engagement member 420A is in the engaged position as shown in FIG. 23. When weight engagement surface 432 and caliper engagement surface 436 are engaged with one another, weight 404 is secured to exercise weight bar 402. In contrast, when weight engagement member 420A is in the disengaged position as shown in FIG. 22, weight engagement surface 432 does not engage caliper engagement surface 436, thereby disengaging weight 404 from exercise weight bar 402.

A ridge 434 is formed between the first and second ends of weight engagement member 420A. Ridge 434 is designed to interact with cam surface 426 of collar 422 to cause weight engagement member 422A to move, pivot, or rotate between the disengaged and engaged positions. As can be seen, ridge 434 extends from weight engagement member 420A toward cam surface 426. As collar 420A rotates about axis A, high and low portions 428, 430 of cam surface 426 alternatingly engage ridge 434. When high portions 428 engages ridge 434, weight engagement member 420A moves, pivots, or rotates to the engaged position as shown in FIG. 23. When ridge 434 is aligned with low portion 430, the biasing member causes weight engagement member 420A to move, pivot, or rotate to the disengaged position as shown in FIG. 22. Since ridge 434 moves as a result of the rotation of cam surface 426, ridge 434 can be referred to as a cam follower. In light of the foregoing discussion, it will be understood that the components of engagement system 415 are examples of means for moving one or more weight engagement members between first and second positions.

Weight mount 412A can include a locking mechanism similar or identical to locking mechanism 124 described above to prevent the weight engagement members (e.g., weight engagement members 420A, 420B) from moving between the disengaged and engaged positions when exercise weight bar 402 is removed from cradle 406. The locking mechanism could be released when exercise weight bar 402 is positioned on cradle 406 to allow selector 410 and collar 422 to rotate so that weight engagement members 420A, 420B can be moved between the engaged and disengaged positions. The locking mechanism can also prevent selector 410 and collar 422 from moving relative to other components of exercise weight bar 402 when exercise weight bar 402 is removed from cradle 406 to prevent the weight engagement members from moving between the engaged and disengaged positions when exercise weight bar 402 is not in cradle 406.

Figure 24:
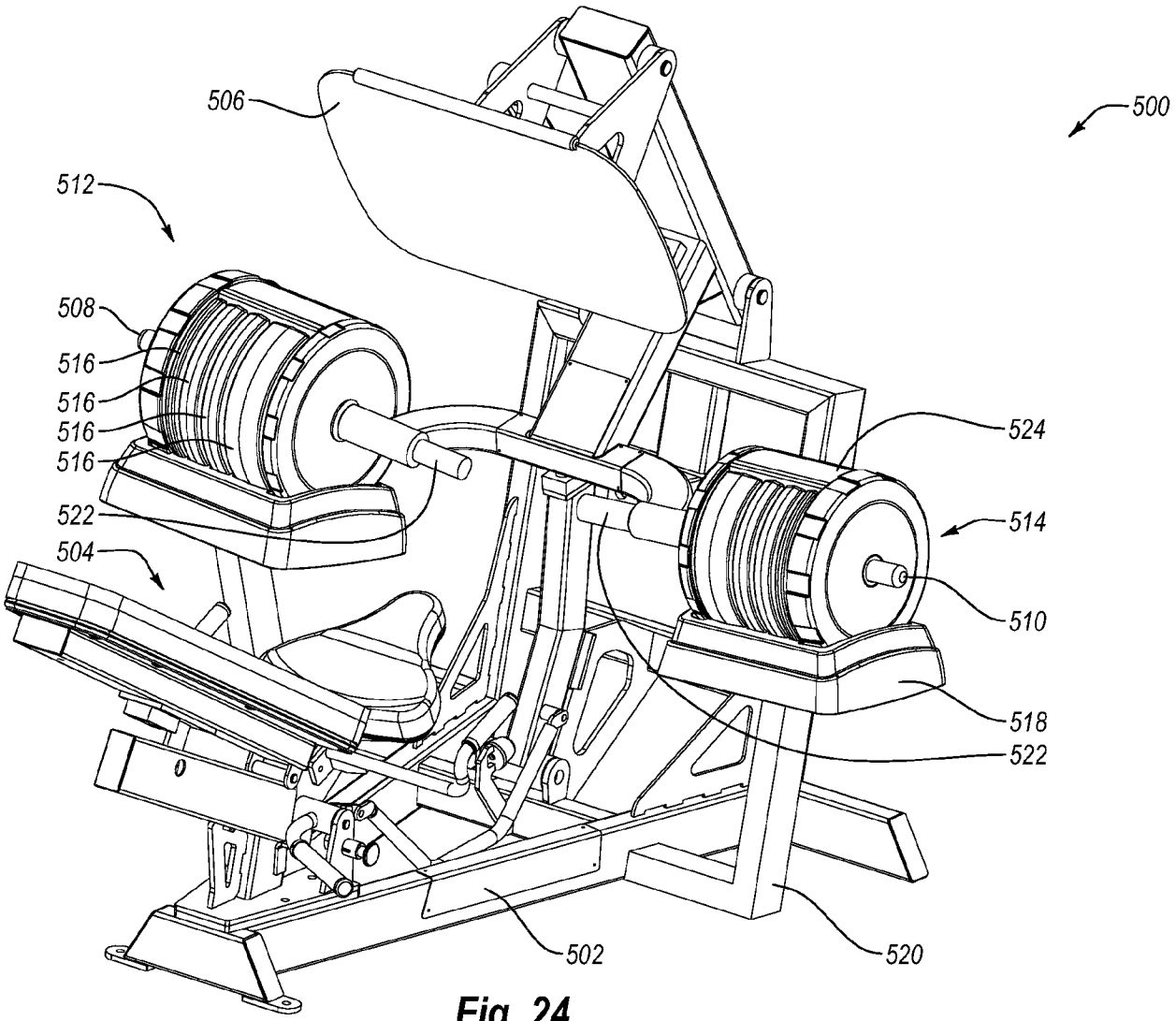
FIG. 24 is a perspective view of an exercise weight system according to still another embodiment of the present invention.

The exercise weight systems of the foregoing exemplary embodiments have shown the present invention incorporated into or in the form of exercise weight bars, such as dumbbells. Nevertheless, the present invention may be incorporated into or take the form of other types of exercise weight systems. By way of example, FIG. 24 illustrates an exercise system 500 that incorporates the principles of the present invention.

Exercise system 500 is a leg press machine that allows a user to lift weights with their legs. Exercise system 500 includes a frame 502 with a bench 504 and a foot plate 506 connected thereto. Bench 504 is designed to have a user sit or lie thereon during exercise. Foot plate 506 is movably connected to frame 502 and positioned relative to bench 504 such that a user sitting or lying on bench 504 may push against foot plate 506. Connected to foot plate 506 are bars 508, 510 to which weights can be securely connected to increase the resistance to the movement of foot plate 506. As a user pushes against and moves foot plate 506, bars 508, 510 and any weights that are connected thereto will also move.

Exercise system 500 also includes weight assemblies 512, 514 that may be used to select and secure weights to bars 508, 510. Weight assemblies 512, 514 may be similar or substantially identical in many respects to the exercise weight systems described above. For instance, with specific focus on weight assembly 514, weight assembly 514 includes bar 510, a plurality of weights 516, and a cradle 518 that holds weights 516. In the illustrated embodiment, cradle 518 is connected to frame 502 via stand 520. Stand 520 may also be free standing and not connected to frame 502.

Weight assembly 514 also includes a selector 522 and a weight mount 524. Weight mount 524 may have a configuration that is similar or identical to the other exercise weight system embodiments described herein. More specifically, weight mount 524 may include collars or other weight engagement members that are moved into and out of engagement with weights 516 as selector 522 is rotated. In a manner similar to those discussed above, rotation of selector 522 may cause a cam system to move the collars or other weight engagement members between engaged and disengaged positions to connect or disconnect weights 516 to bar 510.

In light of the disclosure herein, it will be understood that the principles of the present invention may be incorporated into a variety of different types of exercise weight systems, including, but not limited to, dumbbells, barbells, leg press machines, chest press machines, curl machines, lat machines, fly machines, and the like. That is, weights may be selectively connected to or disconnected from these types of machines through the rotation of a selector that causes a cam system to move weight engagement members into or out of engagement with the weights.

Figure 25:
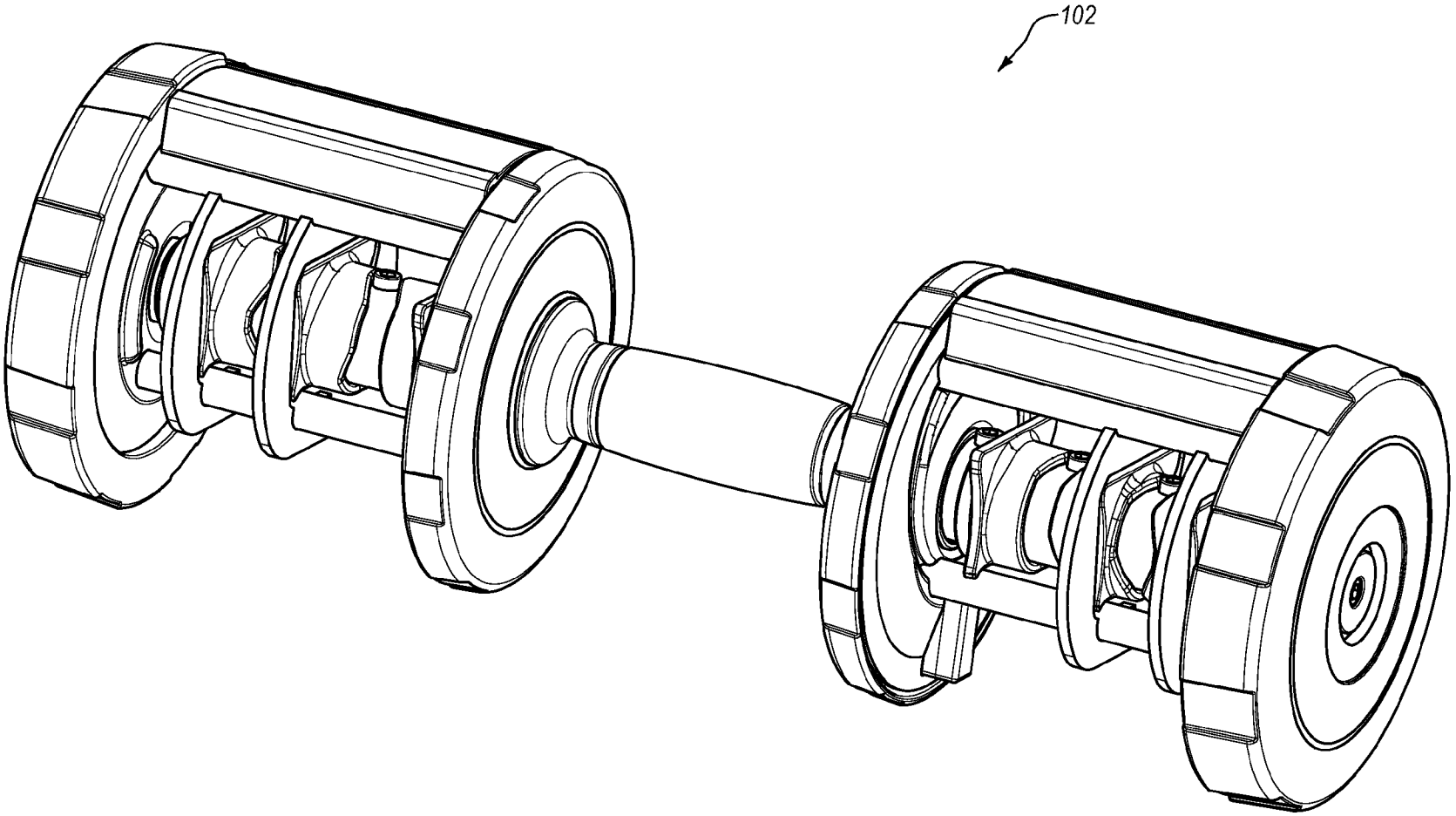
FIG. 25 is a perspective view of the exercise weight bar of FIG. 1.
Figure 26:
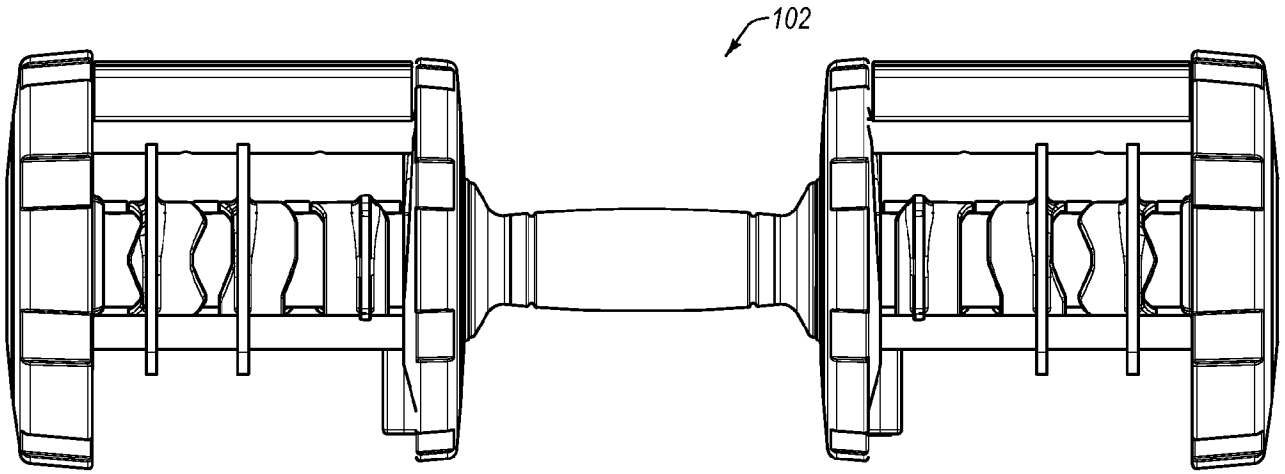
FIG. 26 is a front view of the exercise weight bar of FIG. 1.
Figure 27:
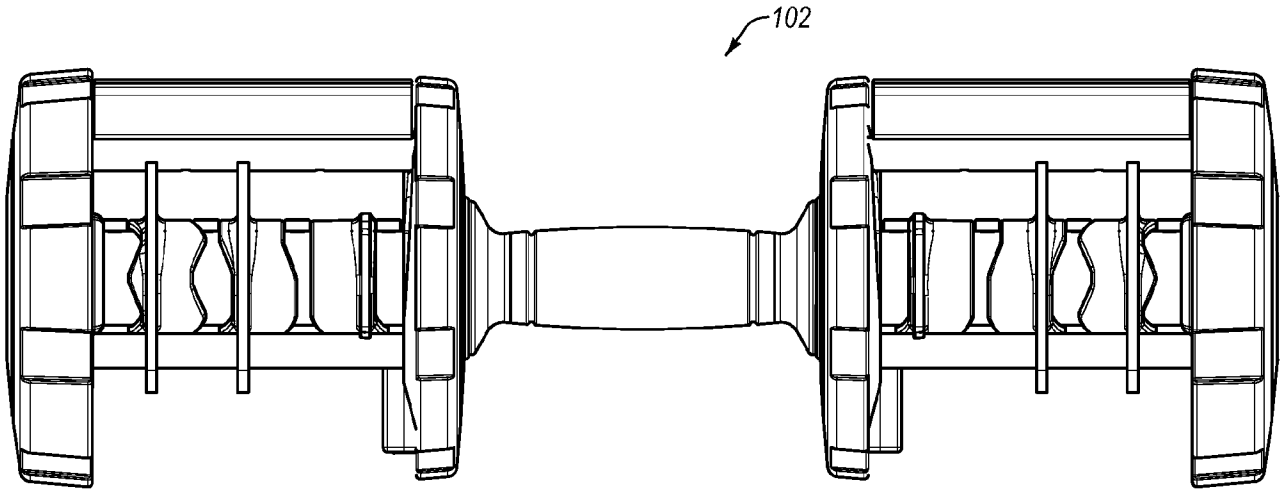
FIG. 27 is a back view of the exercise weight bar of FIG. 1.
Figure 28:
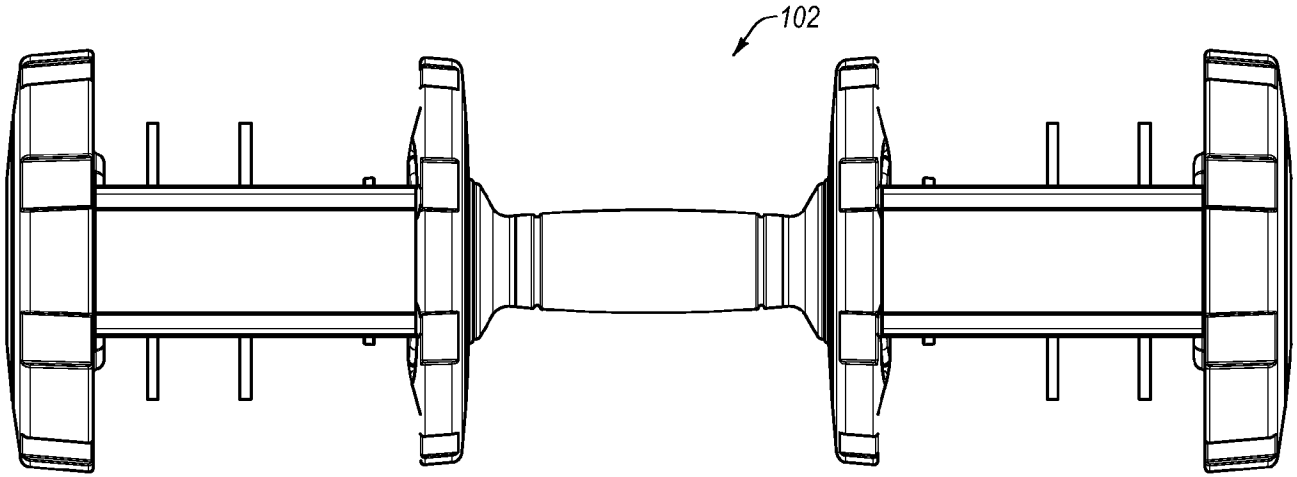
FIG. 28 is a top view of the exercise weight bar of FIG. 1.
Figure 29:
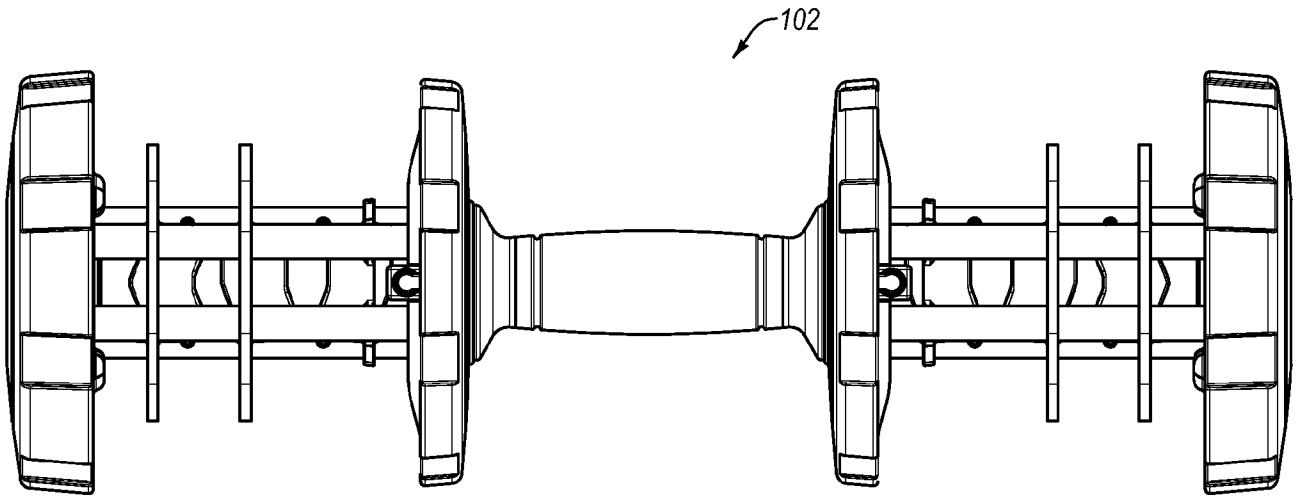
FIG. 29 is a bottom view of the exercise weight bar of FIG. 1.
Figure 31:
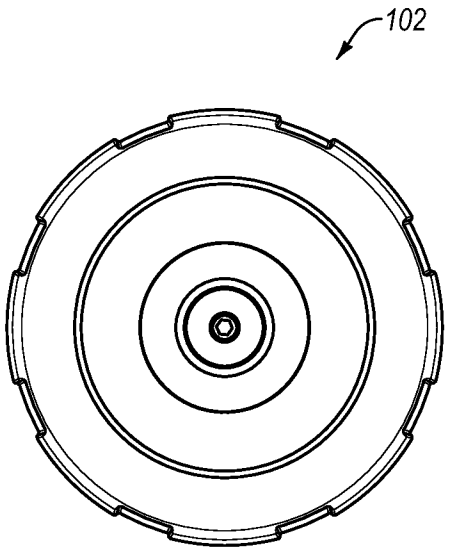
FIG. 31 is a right end view of the exercise weight bar of FIG. 1.
Figure 30:
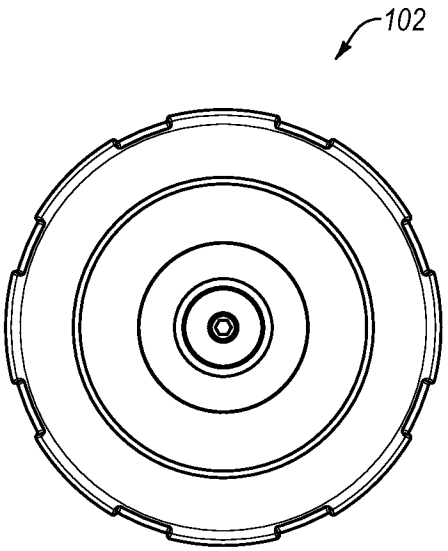
FIG. 30 is a left end view of the exercise weight bar of FIG. 1.
Figure 36:
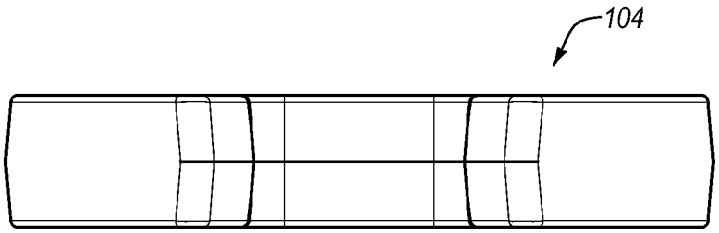
FIG. 36 is a top view of the weight of FIG. 1.
Figure 33:
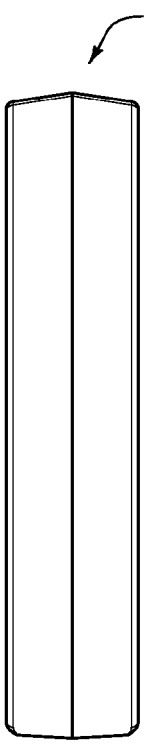
FIG. 33 is a right side view of the weight of FIG. 1.
Figure 35:
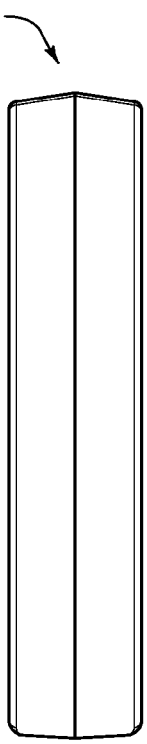
FIG. 35 is a left side view of the weight of FIG. 1.
Figure 37:
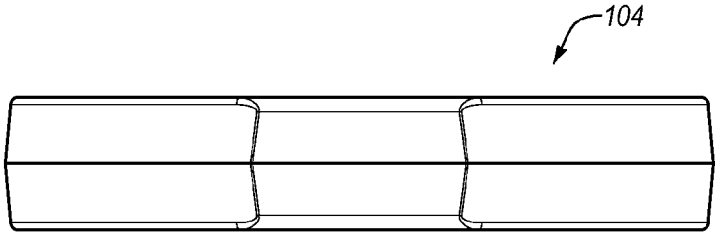
FIG. 37 is a bottom view of the weight of FIG. 1.

FIGS. 25-31 illustrate various views of exercise weight bar 102. In particular, FIG. 25 illustrates a perspective view, FIG. 26 illustrates front view, FIG. 27 illustrates a back view, FIG. 28 illustrates a top view, FIG. 29 illustrates a bottom view, FIG. 30 illustrates right side, and FIG. 31 illustrates a left side view of exercise weight bar 102. Similarly, FIGS. 32-38 illustrate various views of an exemplary weight 104. In particular, FIG. 32 illustrates a perspective view, FIG. 33 illustrates a left side view, FIG. 34 illustrates a front view, FIG. 35 illustrates a right side view, FIG. 36 illustrates a top view, FIG. 37 illustrates a bottom view, and FIG. 38 illustrates back view of weight 104.

The cam systems described herein can be considered to be binary cam systems. More specifically, the alternating engagement of cam followers (e.g., pins 130A-130D, 232, 244, 246, detents 362, ridges 434) with high and low portions of cams (e.g., cam surfaces 156, 158, 160, 162, 164, 166, 330, 342, 426 and cam grooves 224, 226, 228) allows weight engagement members to be moved individually or in various combinations between engaged and disengaged positions. This type of system allows for the selection of nearly any desired combination of weights.

INDUSTRIAL APPLICABILITY

In general, the exercise weight systems of the present invention are intended to enable a user to perform a variety of exercises to develop lean muscle mass, sculpt their body, and burn fat. In particular, the exercise weight systems provide an easy and efficient way for a user to quickly remove and add weights to the exercise weight system with weight securing devices that remain attached to the exercise weight systems during the interchange of weights.

A portable, easily accessible, and/or versatile strength training exercise device may be desirable for use by any person, including those seeking to develop lean muscle mass, sculpt their body, burn fat, avoid obesity, or for any combination of the foregoing. The devices, assemblies, systems, and methods described herein generally relate to exercise weight systems that may be used to perform various exercises in an effort to realize the foregoing benefits.

In the embodiments described herein, the exercise weight systems employ binary cam systems to enable ready and convenient securement of weights to the exercise weight systems. These binary cam systems allow for numerous varieties of weights to be easily secured to the exercise weight systems. More specifically, the binary cam systems include multiple weight engagement members that can be moved individually or in various combinations to engage and secure weights to the exercise weight systems.

For instance, the binary cam systems may include one or a pair of weight engagement members associated with each weight and which can selectively engage the associated weight. The binary cam systems allow for any combination of these weight engagement members to selectively engage weights. By way of example, when the exercise weight system includes three weights and three associated weight engagement members or three pairs of associated weight engagement members, the binary cam systems allow for up to eight different combinations of weights. Thus, employment of binary cam systems enables the weight of the exercise weight systems to be significantly varied through the many combinations provided by the binary cam systems.

In some embodiments of the engagement systems described herein, the binary cam systems translate the rotational movement of the selector into linear or generally linear movement of the weight engagement members. That is, as the selector of the exercise weight system is rotated about the axis of the rod, the weight engagement members are moved at least partially along the axis into and out of engagement with the weights in various combinations. In other embodiments of the engagement systems described herein, the binary cam system translates the rotational movement of the selector into movement of the weight engagement members in a direction that is not necessarily along the axis of the rod. Rather, as the selector of the exercise weight system is rotated about the axis of the rod, the weight engagement members are pivoted, rotated, or otherwise moved radially closer to or further away from the rod into and out of engagement with the weights in various combinations. As is understood, a cam system can be relatively compact, thereby allowing for the exercise weight system described here to be made without being excessively bulky.

In the embodiments where the weight engagement members move axially along the rod, the translation of the rotational movement of the selector to the generally linear movement of the weight engagement members is accomplished with one or more cams and one or more cam followers that are linked to the selector. Either the cams or the cam followers can be linked to the selector so that rotation of the selector causes the cams or the cam followers to rotate as well. The rotation of the cams or cam followers will cause the other to move axially. For instance, if the cams are rotationally linked to the selector, rotation of the cams will cause the cam followers to move linearly or axially. Alternatively, if the cam followers are rotationally linked to the selector, rotation of the cam followers will cause the cams to move linearly or axially. Linear or axial movement of either the cams or the cam surfaces causes the weight engagement members to likewise move in a generally linear or axial direction into and out of engagement with the weights. Thus, the engagement systems are designed such that simply rotating the selector will cause the weights to be engaged or disengaged.

In the embodiments where the weight engagement members move closer to and further away from the rod, the translation of the rotational movement of the selector to the generally radial movement of the weight engagement members is accomplished with one or more cam surfaces and one or more cam followers. The cam surfaces can be linked to the selector so that rotation of the selector causes the cam surfaces to rotate as well. The rotation of the cam surfaces will cause the cam followers to move radially. For instance, rotation of the cam surfaces will cause the cam followers to move radially closer to or further away from the rod. Radial movement of cam followers causes the weight engagement members to likewise move in a generally radial direction into and out of engagement with the weights. Thus, the engagement systems are designed such that simply rotating the selector will cause the weights to be engaged or disengaged.

Each of the weight engagement members includes a weight engaging surface or weight catch and each of the weights includes at least one collar engaging surface or catch channel. When the weight engagement members are moved into the engaged positions, the weight engaging surfaces or weight catches of the weight engagement members engage the collar engaging surfaces or catch channels of the weights. The engagement of these surfaces securely connects the weights to the rod.

The engagement system can be designed in various ways to move the collars between the engaged and disengaged positions. For instance, the engagement system may include one or more pins that extend radially away from the rod. These pins are linked to the selector such that such that rotation of the selector about the rod causes the pins also to rotate about the rod. The pins can be secured along the axis of the rod such that the pins can only rotate about the rod and not move along the axis of the rod. Rotation of the pins around the rod causes the pins to engage one or more cam surfaces on the weight engagement members. As the pins rotate about the rod and engage the cam surfaces, the weight engagement members are forced to move along the axis of the rod. This movement of the weight engagement members along the axis of the rod corresponds to the weight engagement members moving between the engaged and disengaged positions.

According to another embodiment, the engagement system includes one or more cam grooves that are formed around the rod and which are linked to the selector. The linkage between the selector and the cam grooves is such that rotation of the selector about the axis of the rod causes the cam grooves to correspondingly rotate about the axis of the rod. Each of the weight engagement members includes a pin that extends into one of the cam grooves. As the cam grooves rotate about the rod, the pins engage these cam grooves and force the weight engagement members to move along the axis of the rod. This movement of the weight engagement members along the axis of the rod corresponds to the weight engagement members moving between the engaged and disengaged positions In still other embodiments, the engagement system includes one or more collars, each having a cam surface, that are linked to the selector such that the collars and the cam surfaces rotate about the axis of the rod when the selector rotates about the axis of the rod. The rotation of the collars causes one or more weight engagement members to move between engaged and disengaged positions. The rotation of the collars causes the cam surfaces to engage detents on the weight engagement members, thereby moving the weight engagement members along the axis of the rod between the engaged and disengaged positions.

In yet another embodiment, the engagement system includes one or more collars with cam surfaces that rotate about the axis of the rod when the selector rotates about the axis of the rod. The rotation of the collars causes cam surfaces to engage cam followers or ridges on the weight engagement members or calipers to thereby move the weight engagement members closer to or further away from the rod between engaged and disengaged positions.

The exercise weight systems described herein can also include a locking mechanism that locks the collars or weight engagement members in the engaged or disengaged position when the exercise weight bar is being used. The locking mechanism can include a biased lock that either allows the selector and a portion of the engagement mechanism to rotate about axis of the rod so that the weight engagement members can be moved between the engaged and disengaged positions, or prevents the selector and a portion of the engagement system from rotating about the axis of the rod so that the weight engagement members cannot be moved between the engaged and disengaged positions.

For instance, in one embodiment the selector and an end cap are linked together such that rotation of the selector about the rod causes the end cap to rotate about the rod. The lock is linked to the rod so that the lock does not rotate relative to the rod. When the lock is biased into a locked position, the lock engages a notch in the end cap which prevents the end cap, and by connection the selector, from rotating about the rod. As discussed above, rotation of the selector causes the weight engagement members to move between the engaged and disengaged positions. Thus, by preventing the selector from rotating about the axis of the rod, the lock prevents the weight engagement members from moving between the engaged and disengaged positions.

The lock can be moved to an unlocked position so that the selector can be rotated to move the weight engagement members between the engaged and disengaged positions. According to some embodiments, the exercise weight system includes a cradle that can hold at least a portion of the exercise weight system and the weights. Extending up from the cradle is a locking pin that engages the lock when the exercise weight system is positioned on the cradle. When the locking pin engages the lock, the lock is moved to the unlocked position, thereby allowing the selector to rotate to move the weight engagement members between the engaged and disengaged positions. When the exercise weight system is removed from the cradle, the locking pin no longer engages the lock, which allows the lock to be biased into the locked position. Thus, the locking mechanism automatically unlocks when the exercise weight system is positioned in the cradle and automatically locks when the exercise weight system is removed from the cradle.

According to another embodiment of the present invention, an exercise weight system may be designed as a barbell for specific types of exercises, such as bench press exercises. For example, a selector of an exercise weight bar may be sized to be held by two hands that are spread apart. In other embodiments, exercise weight bars may be bent or curved to accommodate various weight-training exercises. In still other embodiments, the present invention may take the form of or be incorporated into such exercise weight system as leg press machines, chest press machines, curl machines, lat machines, fly machines, and the like.

What is claimed is:

1. An exercise weight system comprising:

a rod having a longitudinal axis;

one or more weights selectively securable to the rod;

a selector rotatable relative to the one or more weights; and an engagement system that selectively secures the one or more weights to the rod, the engagement system comprising a cam system having a cam surface configured to rotate about a longitudinal axis of the rod and one or more weight engagement members, wherein rotation of the selector relative to the weights causes the cam system to selectively move the one or more weight engagement members to selectively engage or disengage the one or more weights.

2. The exercise weight system of claim 1, wherein the one or more weight engagement members comprise one or more collars positioned about the rod such that the one or more collars are rotatable about the longitudinal axis of the rod.

3. The exercise weight system of claim 1, wherein the one or more weight engagement members are linked to the selector, wherein rotation of the selector moves the one or more weight engagement members between a first position and a second position to selectively engage or disengage the one or more weights.

4. The exercise weight system of claim 3, wherein each of the one or more weights comprises one or more engagement surfaces and each of the one or more weight engagement members comprises one or more engagement surfaces, wherein the engagement surfaces of the one or more weights and the engagement surfaces of the weight engagement members engage one another only when the weight engagement members are in the first position.

5. The exercise weight system of claim 3, wherein the one or more weight engagement members pivot between the first and second positions.

6. The exercise weight system of claim 5, wherein the cam system comprises one or more collars mounted on the rod such that the one or more collars are rotatable about the longitudinal axis of the rod, each of the one or more collars comprising the cam surface.

7. The exercise weight system of claim 6, wherein the cam system further comprises a cam follower on each of the weight engagement members, wherein the cam followers engage the cam surfaces on the one or more collars.

8. The exercise weight system of claim 7, wherein each of the cam surfaces comprises at least one high portion and at least one low portion.

9. The exercise weight system of claim 8, wherein the at least one high portion and at least one low portion rotate about the axis of the rod as the selector rotates about the axis of the rod.

10. The exercise weight system of claim 8, wherein the cam followers alternatingly engage the high and low portions of the cam surfaces as the selector is rotated about the longitudinal axis of the rod, thereby moving the one or more weight engagement members between the first position and the second position.

11. The exercise weight system of claim 8, wherein the at least one high portion is aligned with a first position along the length of the rod and the at least one low portion is aligned with a second position along the length of the rod.

12. The exercise weight system of claim 8, wherein the at least one high portion is disposed radially further away from the rod than the at least one low portion.

13. The exercise weight system of claim 12, wherein the one or more weight engagement members pivot between the first and second positions in a direction that is at least partially along the length of the rod.

14. The exercise weight system of claim 12, wherein the one or more weight engagement members are pivoted further away from the rod when the one or more weight engagement members are in the first position, and wherein the one or more weight engagement members are pivoted closer to the rod when the one or more weight engagement members are in the second position.

15. The exercise weight system of claim 1, wherein a biasing member biases the one or more weight engagement members toward the first position.

16. An exercise weight system comprising:

a rod having a longitudinal axis;

one or more weights selectively securable to the rod;

a selector positioned on the rod such that the selector is rotatable about the longitudinal axis of the rod, the selector being graspable during the performance of an exercise; and an engagement system that selectively secures the one or more weights to the rod, the engagement system comprising:

one or more weight engagement members positioned about the rod, each of the one or more weight engagement members having at least one cam surface formed thereon, the one or more weight engagement members being movable along at least a portion of the rod between first and second positions;

one or more cam followers linked to the selector such that rotation of the selector about the longitudinal axis of the rod causes the one or more cam followers to rotate about the longitudinal axis of the rod, each of the one or more cam followers engaging at least one of the cam surfaces of the one or more weight engagement members, wherein the engagement between the cam followers and the cam surfaces causes the one or more weight engagement members to move between the first and second positions as the selector and cam followers are rotated about the longitudinal axis of the rod, wherein the one or more weight engagement members disengage the one or more weights when the one or more weight engagement members are in the first position, and the one or more weight engagement members engage and secure the one or more weights to the rod when the one or more weight engagement members are in the second position.

17. The exercise weight system of claim 16, wherein the cam surfaces of each of the one or more weight engagement members comprises at least one high portion and at least one low portion, wherein the one or more weight engagement members are moved to the first position when the cam followers engage the low positions, and wherein the one or more weight engagement members are moved to the second position when the cam followers engage the high positions.

18. An exercise weight system comprising:

a rod having a longitudinal axis;

one or more weights selectively securable to the rod;

a selector mounted on the rod and being rotatable about the longitudinal axis of the rod, the selector being graspable during the performance of an exercise; and an engagement system that selectively secures the one or more weights to the rod, the engagement system comprising:

one or more collars positioned about the rod and being rotatable about the longitudinal axis of the rod, the one or more collars being linked to the selector such that rotation of the selector about the longitudinal axis of the rod causes the one or more collars to rotate about the longitudinal axis of the rod, each of the one or more collars having at least one cam surface formed thereon, one or more weight engagement members that pivot between first and second positions relative to the rod, each of the one or more weight engagement members comprising a cam follower that engages at least one of the cam surfaces of the one or more collars, wherein the engagement between the cam followers and the cam surfaces causes the one or more weight engagement members to pivot between the first and second positions as the selector and collars are rotated about the longitudinal axis of the rod, wherein the one or more weight engagement members disengage the one or more weights when the one or more weight engagement members are in the first position, and the one or more weight engagement members engage and secure the one or more weights to the rod when the one or more weight engagement members are in the second position.

19. The exercise weight bar of claim 18, wherein the weight engagement members pivot between the first and second positions in one or more planes that are generally perpendicular to the longitudinal axis of the rod.

* * * * *